US011142941B2

(12) United States Patent
Summy

(10) Patent No.: US 11,142,941 B2
(45) Date of Patent: Oct. 12, 2021

(54) SILL PAN ASSEMBLY FOR DOOR SYSTEMS AND METHOD OF INSTALLATION

(71) Applicant: Gene Summy, Laguna Niguel, CA (US)

(72) Inventor: Gene Summy, Laguna Niguel, CA (US)

( * ) Notice: Subject to any disclaimer, the term of this patent is extended or adjusted under 35 U.S.C. 154(b) by 32 days.

(21) Appl. No.: 16/820,236

(22) Filed: Mar. 16, 2020

(65) Prior Publication Data

US 2020/0291715 A1 Sep. 17, 2020

Related U.S. Application Data

(60) Provisional application No. 62/819,359, filed on Mar. 15, 2019.

(51) Int. Cl.
*E06B 1/62* (2006.01)
*E06B 1/70* (2006.01)

(52) U.S. Cl.
CPC ..... *E06B 1/62* (2013.01); *E06B 1/70* (2013.01); *E06B 2001/628* (2013.01)

(58) Field of Classification Search
None
See application file for complete search history.

(56) References Cited

U.S. PATENT DOCUMENTS

| | | | | |
|---|---|---|---|---|
| 993,861 | A | 5/1911 | McRonald | |
| 1,677,160 | A | 7/1928 | Woolfenden | |
| 1,950,519 | A | 3/1934 | Ripley | |
| 2,043,049 | A | 6/1936 | Ludden | |
| 2,648,107 | A | 8/1953 | Bates, Jr. | |
| 2,962,405 | A | 11/1960 | Morthland | |
| 3,238,679 | A | 3/1966 | Capoccia | |
| 3,451,178 | A | 6/1969 | Beale | |
| 3,698,142 | A | 10/1972 | Theriault | |
| 4,126,975 | A * | 11/1978 | Williams | E06B 1/18 49/505 |
| 4,248,926 | A | 2/1981 | Tajima et al. | |
| 4,555,882 | A | 12/1985 | Moffitt et al. | |
| 4,700,512 | A | 10/1987 | Laska | |
| 4,775,567 | A | 10/1988 | Harkness | |
| 4,872,296 | A | 10/1989 | Janni | |
| 5,077,943 | A | 1/1992 | McGady | |
| 5,109,641 | A | 5/1992 | Halan | |
| 5,218,793 | A | 6/1993 | Ball | |
| 5,255,481 | A | 10/1993 | Misera et al. | |
| 5,303,522 | A | 4/1994 | Vagedes | |
| 5,414,964 | A | 5/1995 | Bodycomb | |
| 5,586,415 | A | 12/1996 | Fisher et al. | |
| 5,706,610 | A | 1/1998 | Mayle | |

(Continued)

OTHER PUBLICATIONS

Forti Flash; Fortifiber Building Products Systems; Websites at www.fortifiber.com.

(Continued)

*Primary Examiner* — Joshua K Ihezie
(74) *Attorney, Agent, or Firm* — Knobbe Martens Olson & Bear LLP

(57) ABSTRACT

Features for systems and methods of providing a sill pan for door systems are described. More specifically, features for systems and methods for flashing and sealing around exterior door systems such as pocket doors, stacking doors, French doors, and traditional sliding doors.

20 Claims, 17 Drawing Sheets

(56) References Cited

U.S. PATENT DOCUMENTS

| | | | |
|---|---|---|---|
| 5,815,986 | A | 10/1998 | Laska |
| 5,913,779 | A | 6/1999 | Edvardsen |
| 5,927,039 | A | 7/1999 | De Boer |
| 6,035,582 | A | 3/2000 | Pacific |
| 6,070,370 | A | 6/2000 | Locke |
| 6,098,343 | A | 8/2000 | Brown et al. |
| 6,119,416 | A | 9/2000 | Larson |
| 6,122,874 | A | 9/2000 | Smerilli |
| 6,122,887 | A | 9/2000 | Massett et al. |
| 6,256,956 | B1 | 7/2001 | Davis |
| 6,327,820 | B1 | 12/2001 | Picco |
| 6,401,401 | B1 | 6/2002 | Williams |
| 6,401,402 | B1 | 6/2002 | Williams |
| 7,222,462 | B2 | 5/2007 | Ellingson |
| 7,451,571 | B2 | 11/2008 | Ross |
| 7,673,426 | B2 | 3/2010 | Broad |
| 7,676,996 | B2 | 3/2010 | Teodorovich |
| 7,735,291 | B2 | 6/2010 | Summy |
| 7,775,004 | B2 | 8/2010 | Allen |
| 7,877,940 | B2 | 2/2011 | Meeks |
| 7,877,945 | B2 | 2/2011 | Eggen |
| 8,069,622 | B2 | 12/2011 | Mees |
| 8,869,462 | B2 | 10/2014 | Baron |
| 9,032,688 | B2 | 5/2015 | Summy |
| 9,163,450 | B2 | 10/2015 | Messenger |
| D748,826 | S | 2/2016 | Norwood |
| 9,341,018 | B2 | 5/2016 | Helton |
| 9,702,468 | B2 | 7/2017 | Newhouse |
| 9,845,624 | B2 | 12/2017 | Heid |
| 9,909,353 | B2 | 3/2018 | Hendricks |
| 9,982,477 | B1 | 5/2018 | Glickman |
| 10,024,097 | B1 | 7/2018 | Glickman |
| 10,065,580 | B1 | 9/2018 | Newman |
| 10,161,179 | B2 | 12/2018 | Norwood |
| 10,273,741 | B1 * | 4/2019 | Summy ..... E06B 1/62 |
| 2001/0034984 | A1 | 11/2001 | Murphy et al. |
| 2002/0050103 | A1 | 5/2002 | Ackerman, Jr. |
| 2003/0056444 | A1 | 3/2003 | Ackerman, Jr. |
| 2006/0260213 | A1 | 11/2006 | Williams |
| 2007/0289226 | A1 | 12/2007 | Lokkart |
| 2012/0032406 | A1 | 2/2012 | Ksiezoposki |
| 2012/0144761 | A1 | 6/2012 | Teodorovich |

OTHER PUBLICATIONS

Future Flash, Window Waterproofing System; MFM Building Products Corp., 525 Orange Street, Coshocton, OH 43812; (740) 622-2645; (800) 882-7663.

* cited by examiner

SILL PAN ASSEMBLY FOR DOOR SYSTEMS AND METHOD OF INSTALLATION

CROSS-REFERENCE TO RELATED APPLICATION

This application claims benefit under 35 U.S.C. § 119(e) to U.S. Provisional Patent App. No. 62/819,359, filed Mar. 15, 2019, the entire disclosure of which is hereby incorporated by reference herein in its entirety. Any and all priority claims identified in the Application Data Sheet, or any corrections thereto, are hereby incorporated by reference under 37 CFR § 1.57.

BACKGROUND

Field

Features for systems and methods of providing a sill pan for door systems are described. More specifically, features for systems and methods for flashing and sealing around exterior door systems such as pocket doors, stacking doors, French doors, and traditional sliding doors.

Description of the Related Art

In the construction of new homes, it is important to provide a water-tight seal at the seams of any openings in exterior walls, specifically windows and doors. A number of different devices and methods of providing such a seal are in current use. All of these methods have at least one major drawback. Some are expensive, some are time consuming, some must be performed just right in order to be effective, some are not durable, and some create sharp edges that cut subsequent layers of building materials.

Door systems along the exterior of a building create an entry point for water or other debris to enter the structure between the door and door opening. Water entering through the door opening can cause water damage to the building. Sill pans decrease water penetration at these entry points by collecting and directing the water and other debris outside the building.

SUMMARY

The embodiments disclosed herein each have several aspects no single one of which is solely responsible for the disclosure's desirable attributes. Without limiting the scope of this disclosure, its more prominent features will not be briefly discussed. After considering this discussion, and particularly after reading the section entitled "Detailed Description," one will understand how the features of the embodiments described herein provide advantages over existing systems, devices, and methods.

The following disclosure describes non-limiting examples of some embodiments. For instance, other embodiments of the disclosed systems and methods may or may not include the features described herein. Moreover, disclosed advantages and benefits can apply only to certain embodiments of the invention and should not be used to limit the disclosure.

In one aspect described herein, a method of installing a multi-piece, flexible, sill pan in a framed wall condition in a building wall that is configured to receive a pocket door for a doorway is disclosed. The framed wall condition includes an inner frame, an outer frame, and a first door stud together defining an internal space for receiving the pocket door. A bottom of the internal space is formed by a channel in a subfloor, the channel in the subfloor extends from the first door stud to a second door stud disposed on an opposite side of the doorway. The method comprises securing a first flexible end dam member between the inner and outer frames, and against the first door stud such that a first vertical seating flange of the first flexible end dam member contacts a generally vertical surface of the first door stud, a second vertical seating flange of the first flexible end dam member contacts a generally vertical surface of the inner frame, a third vertical seating flange of the first flexible end dam member contacts a generally vertical surface of the outer frame, and a generally horizontal base of the first flexible end dam member contacts a generally horizontal surface of the subfloor in the channel. The method further includes securing a first flexible corner member against the second door stud such that a first vertical seating flange of the first flexible corner member contacts a first generally vertical surface of the second door stud, a second vertical seating flange of the first flexible corner member contacts a second generally vertical surface of the second door stud outside the channel, a generally horizontal seating flange of the first flexible corner member contacts a generally horizontal surface of the subfloor in the channel. The method further includes securing a second flexible corner member to the outer frame and the subfloor such that a first vertical seating flange of the second flexible corner member contacts a generally vertical surface of an end of the outer frame, a second vertical seating flange of the second flexible corner member contacts a generally vertical surface of the outer frame, a third generally vertical seating flange of the second flexible corner member contacts a generally vertical surface of the subfloor outside the channel, and a generally horizontal seating flange of the second flexible corner member contacts a generally horizontal surface of the subfloor in the channel. The method further includes securing a second flexible end dam member against the first flexible corner member such that a first vertical seating flange of the second flexible end dam member contacts the first vertical seating flange of the first flexible corner member, a second vertical seating flange of the second flexible end dam member contacts the second vertical seating flange of the first flexible corner member, and a generally horizontal base of the second flexible end dam member contacts the generally horizontal seating flange of the first flexible corner member. The method further includes securing a flexible insert in the channel in the subfloor and between the first and second flexible end dams such that a base of the flexible insert contacts a generally horizontal surface of the subfloor in the channel and overlaps the horizontal seating flange of the second flexible corner member, a first end of the flexible insert overlaps at least a portion of the horizontal seating flange of the first flexible end dam member, and a second end of the flexible insert overlaps at least a portion of the horizontal seating flange of the second flexible end dam member.

In another aspect described herein, a method of installing a multi-piece sill pan in a framed wall condition in a building wall that is configured to receive a door for a doorway is disclosed. The framed wall condition includes a first door stud and a second door stud defining a doorway therebetween for receiving the door. The method comprises securing a first corner member against the first door stud such that a first vertical seating flange of the first corner member overlaps a first vertical surface of the first door stud, a second vertical seating flange of the first corner member overlaps a second vertical surface of the first door stud outside the doorway, a horizontal seating flange of the first corner member overlaps a horizontal surface in the doorway. The method further includes securing a second corner member against the second door stud such that a first vertical seating flange of the second corner member overlaps a first vertical surface of the second door stud, a second vertical seating flange of the second corner member overlaps a second vertical surface of the second door stud outside the doorway, a horizontal seating flange of the second corner member overlaps the horizontal surface in the doorway. The method further includes securing a first end dam member over the first corner member such that a first vertical seating flange of the first end dam member overlaps the first vertical seating flange of the first corner member, a second vertical seating flange of the first end dam member overlaps the second vertical seating flange of the first corner member, and a generally horizontal base of the first end dam member overlaps the horizontal seating flange of the first corner member. The method further includes securing a second end dam member over the second corner member such that a first vertical seating flange of the second end dam member overlaps the first vertical seating flange of the second corner member, a second vertical seating flange of the second end dam member overlaps the second vertical seating flange of the second corner member, and a generally horizontal base of the second end dam member overlaps the horizontal seating flange of the second corner member. The method further includes securing an insert in the doorway and between the first and second end dams such that a base of the insert overlaps a horizontal surface in the doorway, a first end of the insert overlaps at least a portion of the horizontal seating flange of the first end dam member and at least a portion of the horizontal seating flange of the first corner member, and a second end of the insert overlaps at least a portion of the horizontal seating flange of the second end dam member and at least a portion of the horizontal seating flange of the second corner member.

In another aspect described herein, a kit for a multi-piece sill pan to be installed in a framed wall condition in a building wall that is configured to receive a door for a doorway is disclosed. The framed wall condition includes a first door stud and a second door stud defining a doorway therebetween for receiving the door. The kit comprises a first corner member configured to be secured against the first door stud such that a first vertical seating flange of the first corner member overlaps a first vertical surface of the first door stud, a second vertical seating flange of the first corner member overlaps a second vertical surface of the first door stud outside the doorway, a horizontal seating flange of the first corner member overlaps a horizontal surface in the doorway.

The kit further comprises a second corner member configured to be secured against the second door stud such that a first vertical seating flange of the second corner member overlaps a first vertical surface of the second door stud, a second vertical seating flange of the second corner member overlaps a second vertical surface of the second door stud outside the doorway, a horizontal seating flange of the second corner member overlaps the horizontal surface in the doorway.

The kit further comprises a first end dam member configured to be secured over the first corner member such that a first vertical seating flange of the first end dam member overlaps the first vertical seating flange of the first corner member, a second vertical seating flange of the first end dam member overlaps the second vertical seating flange of the first corner member, and a generally horizontal base of the first end dam member overlaps the horizontal seating flange of the first corner member.

The kit further comprises a second end dam member configured to be secured over the second corner member such that a first vertical seating flange of the second end dam member overlaps the first vertical seating flange of the second corner member, a second vertical seating flange of the second end dam member overlaps the second vertical seating flange of the second corner member, and a generally horizontal base of the second end dam member overlaps the horizontal seating flange of the second corner member.

The kit further comprises an insert configured to be secured in the doorway and between the first and second end dams such that a base of the insert overlaps a horizontal surface in the doorway, a first end of the insert overlaps at least a portion of the horizontal seating flange of the first end dam member and at least a portion of the horizontal seating flange of the first corner member, and a second end of the insert overlaps at least a portion of the horizontal seating flange of the second end dam member and at least a portion of the horizontal seating flange of the second corner member.

BRIEF DESCRIPTION OF THE DRAWINGS

The foregoing and other features of the present disclosure will become more fully apparent from the following description and appended claims, taken in conjunction with the accompanying drawings. Understanding that these drawings depict only several embodiments in accordance with the disclosure and are not considered limiting of its scope, the disclosure will be described with additional specificity and detail through use of the accompanying drawings. In the following detailed description, reference is made to the accompanying drawings, which form a part hereof. In the drawings, similar symbols typically identify similar components, unless context dictates otherwise. The illustrative embodiments described in the detailed description, drawings, and claims are not meant to be limiting. Other embodiments may be utilized, and other changes may be made, without departing from the spirit or scope of the subject matter presented here. It will be readily understood that the aspects of the present disclosure, as generally described herein, and illustrated in the drawing, can be arranged, substituted, combined, and designed in a wide variety of different configurations, all of which are explicitly contemplated and make part of this disclosure.

FIG. 8A shows an embodiment of applying sealant within a channel of the internal space before placing the first end dam. FIG. 8B shows the first end dam placed on the applied sealant in the channel. FIG. 8C shows an embodiment of further securing the first end dam with fasteners, such as staples.

FIG. 9A shows an embodiment of applying sealant at the entrance to the internal space in the building wall before placing the first corner member. FIG. 9B shows an embodiment of the first corner member placed on the applied sealant. FIG. 9C shows an embodiment of wrapping the first corner member around the entrance to the internal space in the building wall. FIG. 9D shows an embodiment of the first corner member further secured to the building wall with fasteners, such as staples.

FIG. 10A shows an embodiment of applying sealant before placing the insert. FIG. 10B shows an embodiment of the insert placed in the channel. FIG. 10C shows an embodiment of removing a portion of a side of the insert aligning with an edge of the subfloor.

FIG. 11A shows an embodiment of applying sealant before placing the second corner member. FIG. 11B shows an embodiment of placing the second corner member near the door stud.

FIG. 12A shows an embodiment of applying sealant before placing the second end dam. FIG. 12B shows an embodiment of placing the second end dam on the second corner member near the right door stud. FIG. 12C shows an embodiment of wrapping a portion of the second end dam placed in FIG. 12B around the second corner member and the right door stud of the building wall.

FIG. 12D shows an embodiment of the insert aligned with the horizontal surface and the second end dam. Sealant is applied to the horizontal surface and the second end dam before placement of the insert. FIG. 12E shows an embodiment of wrapping a portion of the insert around the edge of the subfloor. FIG. 12F shows an alternate embodiment to FIG. 12E where the portion of the insert is removed instead of being wrapped around the edge of the subfloor.

FIG. 13A shows an embodiment of placing a corner member near the right door stud. Sealant is applied before placing the corner member. FIG. 13B shows an embodiment of placing an end dam on the corner member near the right door stud prior to wrapping a portion of the end dam around the corner member and the right door stud of the building wall. FIG. 13C shows an embodiment where a portion of the end dam is wrapped around the corner member and the right door stud of the building wall. FIG. 13C also shows a right side portion of an insert being placed on a horizontal surface and on the end dam member. FIG. 13C also shows an embodiment where a portion of the insert is wrapped around the edge of the subfloor. FIG. 13D shows an alternate embodiment to FIG. 13C where the portion of the insert is removed instead of being wrapped around the edge of the subfloor. While not shown in FIG. 13D.

FIG. 13E shows an embodiment of placing a corner member near the right door stud. Sealant is applied before placing the first corner member. FIG. 13F shows an embodiment of placing an end dam on the corner member near the right door stud prior to wrapping a portion of the end dam around the corner member and the right door stud of the building wall. FIG. 13G shows an embodiment of wrapping a portion of the end dam around the corner member and the right door stud of the building wall. FIG. 13G also shows a right side portion of an insert being placed on a horizontal surface and on the end dam member. FIG. 13G also shows an embodiment of wrapping a portion of the insert around the edge of the subfloor. FIG. 13H shows an alternate embodiment to FIG. 13G where the portion of the insert is removed instead of being wrapped around the edge of the subfloor. While not shown in FIG. 13H.

FIG. 13I shows both the right door stud and the left door stud of the recessed threshold from FIGS. 13A-D with the first and second corners members installed.

FIG. 13J shows both the right door stud and the left door stud of the recessed threshold from FIGS. 13A-D with the insert installed.

FIG. 13K shows both the right door stud and the left door stud of the flat threshold from FIGS. 13E-H with the first and second corners members installed.

FIG. 13L shows both the right door stud and the left door stud of the flat threshold from FIGS. 13E-H with the insert installed.

DETAILED DESCRIPTION

Figure 1:
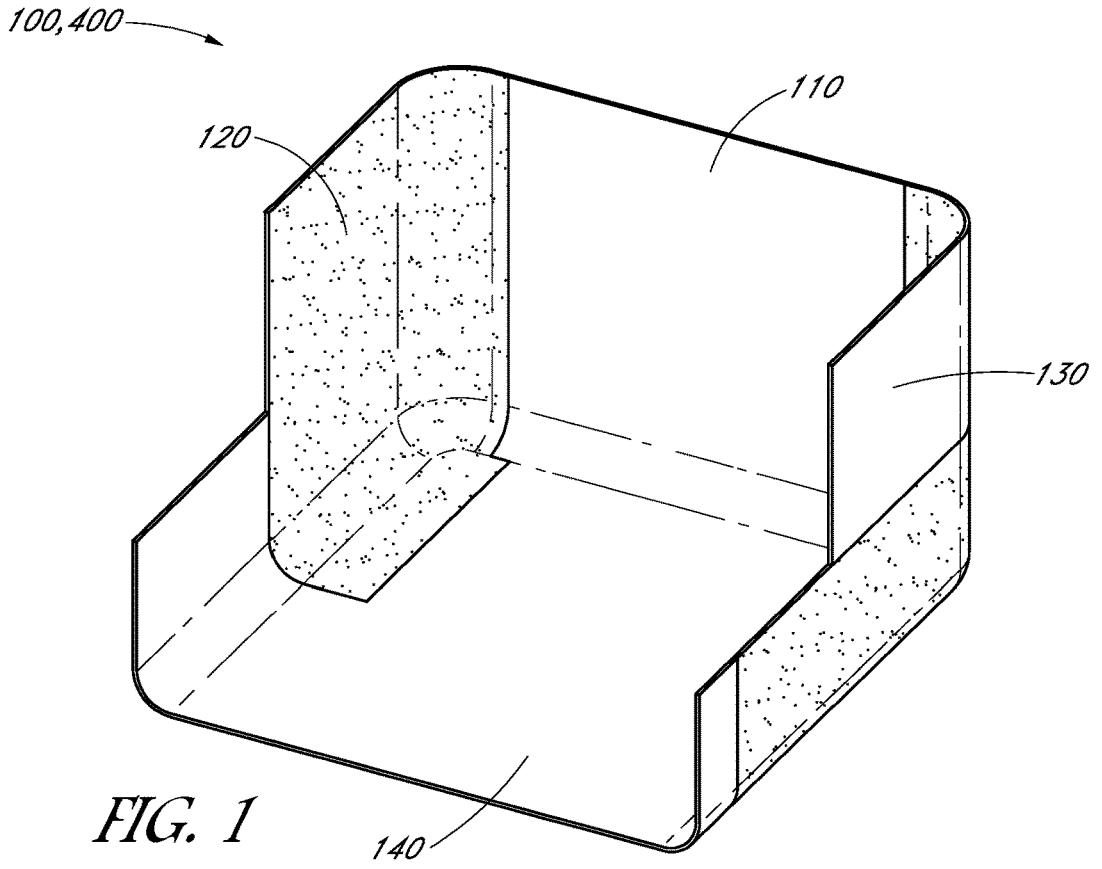
FIG. 1 is a front perspective view of an embodiment of a first end dam of a sill pan assembly for use in systems and methods for exterior doors such as pocket doors, stacking doors, French doors, and traditional sliding doors.

The following detailed description is directed to certain specific embodiments of the invention. However, the invention can be embodied in a multitude of different ways. It should be apparent that the aspects herein may be embodied in a wide variety of forms and that any specific structure, function, or both being disclosed herein is merely representative of one or more embodiments of the invention. An aspect disclosed herein may be implemented independently of any other aspects and that two or more of these aspects may be combined in various ways. For example, a device (e.g., the illustrated embodiments of a multi-piece, flexible sill pan assembly for exterior door systems such as pocket doors including multi-panel pocket doors, stacking doors, French doors, and traditional sliding doors may be implemented, or a method may be practiced, using any number of the aspects set forth herein. In addition, such a device may be implemented or such a method may be practiced using other structure, functionality, or structure and functionality in addition to, or other than one or more of the aspects set forth herein.

Certain embodiments of the disclosed sill pan assembly provide advantages over existing sill pan designs. For example, the flexibility of the material used for certain embodiments of the sill pan assembly allows the sill pan assembly to conform to size variations and tolerance ranges of the channel within the internal space. Certain embodiments of the sill pan assembly further do not sweat as caused by water condensation. Certain embodiments of the sill pan assembly are not hard plastic and thus are not susceptible to cracking or twisting due to heat. Certain embodiments of the sill pan assembly are not sticky and thus do not have compatibility issues with sealant. Certain embodiments of the sill pan assembly do not cause electrolysis with the concrete in contrast to metal sill pans.

The description of the disclosed implementations is provided to enable any person skilled in the art to make or use the present disclosure. Various modifications to these implementations will be readily apparent to those skilled in the art, and the generic principles defined herein may be applied to other implementations without departing from the spirit or scope of the disclosure. Thus, the present disclosure is not intended to be limited to the implementations shown herein but is to be accorded the widest scope consistent with the principles and novel features disclosed herein.

The foregoing description details certain embodiments of the devices and methods disclosed herein. It will be appreciated, however, that no matter how detailed the foregoing appears in text, the devices and methods can be practiced in many ways. It should be noted that the use of particular terminology when describing certain features or aspects of the invention should not be taken to imply that the terminology is being re-defined herein to be restricted to including any specific characteristics of the features or aspects of the technology with which that terminology is associated.

FIGS. 1-6 show the pieces of an embodiment of a sill pan assembly. The sill pan assembly comprises a first end dam 100/400, a second end dam 100/400, an insert 200, a first corner member 300/500, and a second corner member 300/500. The identification of an end dam or a corner member as being "first" or "second" is merely for convenience of description and is not indicative of an order of installation or a specific side of a doorway or threshold where the component is placed. Accordingly, in certain embodiments, "first" can refer to a component of the sill pan assembly placed on the left side or on the right side of the doorway. Similarly, in certain embodiments, "first" can refer to a component of the sill pan assembly that is placed before another of the same component or after another of the same component. Each component is described in more detail below.

Figure 2:
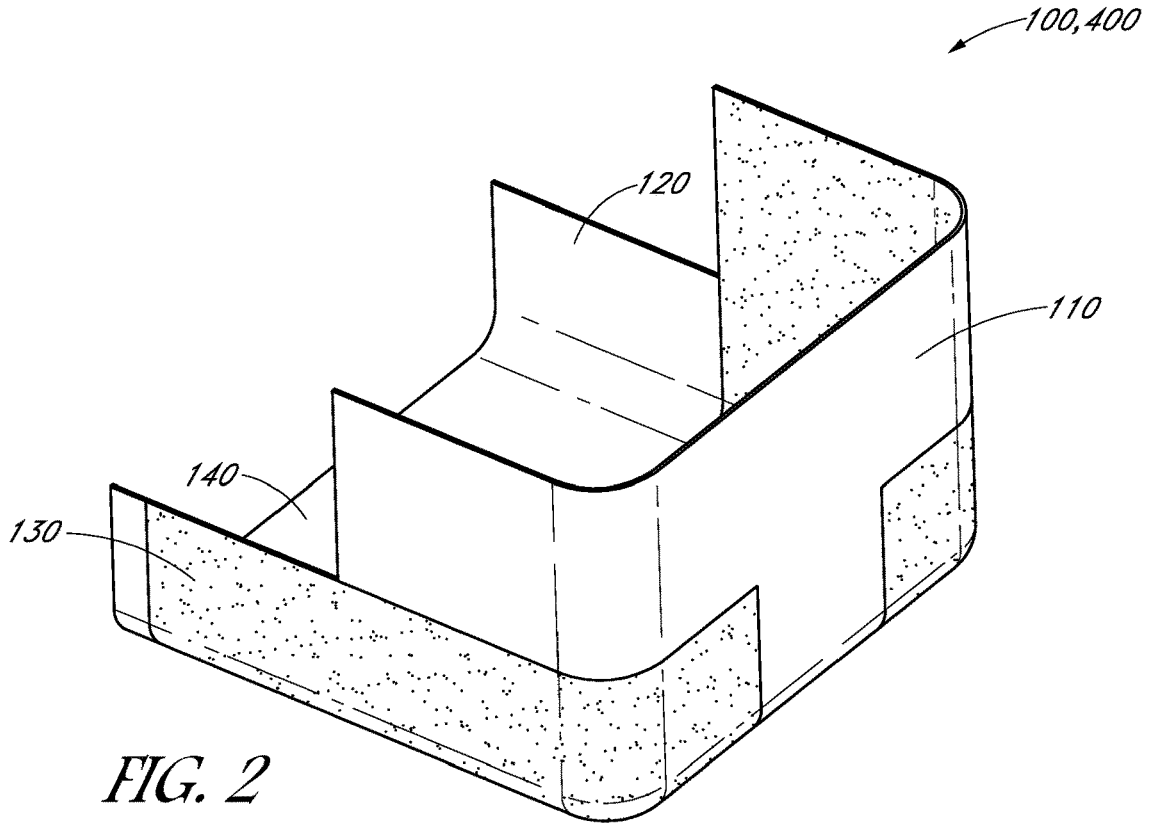
FIG. 2 is a rear perspective view of the first end dam shown in FIG. 1.

FIGS. 1 and 2 are perspective views of an embodiment of an end dam which may be configured as the first end dam 100 and the second end dam 400. The end dam 100, 400 may have a first vertical seating flange 110, a second vertical seating flange 120, a third vertical seating flange 130, and a base 140. In some embodiments, the first vertical seating flange 110 and the base 140 are generally perpendicular to each other. The first vertical seating flange 110 may be generally perpendicular to the second vertical seating flange 120 and/or the third vertical seating flange 130. The second vertical seating flange 120 and the third vertical seating flange 130 may be generally parallel to each other. The second vertical seating flange 120 and the third vertical seating flange 130 may be generally L-shaped. In some embodiments, the second and/or third seating flanges 120, 130 may have another shape. In some embodiments, the second and/or third vertical seating flanges may have rounded or curved corners. In some embodiments, the second vertical seating flange 120 may have a shape that is different from the shape of the third seating flange 130.

In some embodiments, the height of the first vertical seating flange 120 and the length of the base 140 may be the same or similar. In other embodiments, the height of the first vertical seating flange 120 may be greater than or less than the length of the base 140.

The end dam 100, 400 may be constructed of an asphalt-, butyl-, or petroleum-based material. Exemplary materials for the end dam 100, 400 are sold by Fortifiber Building Systems Group Inc., Henry Company, and MFM Building Products Corp. In some embodiments, the material may have an adhesive backing. In some embodiments, the material is a flexible flashing material. In other embodiments, the end dam 100, 400 may be constructed of other materials having water-resistant or water-impermeable properties, for example, but not limited to, butyl rubber, polyvinylidene fluoride, and acrylics. In some embodiments, the end dam 100, 400 is constructed of one type of material. In other embodiments, the end dam 100, 400 is constructed of two or more types of materials.

In some embodiments, the end dam 100, 400 is an integral component. In other embodiments, the end dam 100, 400 is constructed of two or more components. For example, the end dam 100, 400 may be constructed by connecting one component to at least one other component. In some embodiments, the end dam 100, 400 may be constructed by folding one component into the shape of the end dam 100, 400 shown in FIG. 1 and connecting at least one other component, which assists in maintaining the shape of the end dam. For example, the solid white area of end dam 100, 400, as shown in FIGS. 1 and 2, may be a first component, and the patterned areas of end dam 100, 400, shown on the inside and outside, may be the other components. As shown in FIG. 1, the inside corners may each have an added component. As shown in FIG. 2, the outside corners may each have an added component.

In some embodiments, the end dam 100, 400 may be formed by applying a first piece of adhesive-backed material to an end dam such that the first piece partially overlaps a cut edge of the end dam and then applying a second piece of adhesive-backed material to laminate the end dam. In such an embodiment, the first and second pieces of adhesive-backed material may assist in making the corners of the end dam. In some embodiments, the first and second pieces may not have an adhesive backing, but rather, are applied using a separate adhesive.

Disclosure regarding exemplary embodiments of sill pan assemblies are disclosed in U.S. Pat. No. 10,273,741, granted Apr. 30, 2019 and entitled "Sill Pan Assembly for Pocket Door Systems and Method of Installation," the entire disclosure of which is hereby incorporated by reference. Disclosure regarding exemplary embodiments of the corner member are disclosed in U.S. Pat. No. 9,032,688, granted May 19, 2015 and entitled "Corner Flashing System," the entire disclosure of which is hereby incorporated by reference. Gene Summy is the inventor of said applications as well as of the subject application.

Figure 3:
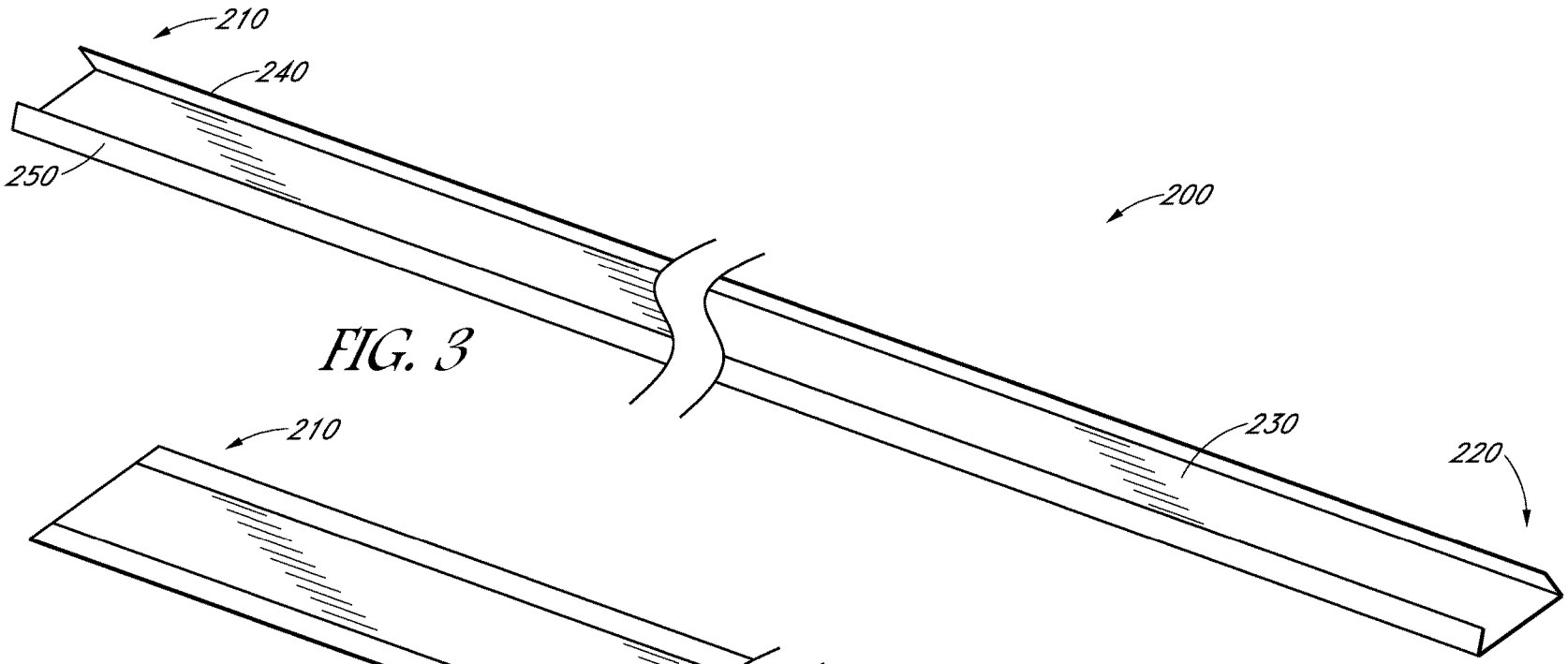
FIG. 3 is a perspective view of an embodiment of an insert of the sill pan assembly that has seating flanges folded-up to form a channel.
Figure 4:
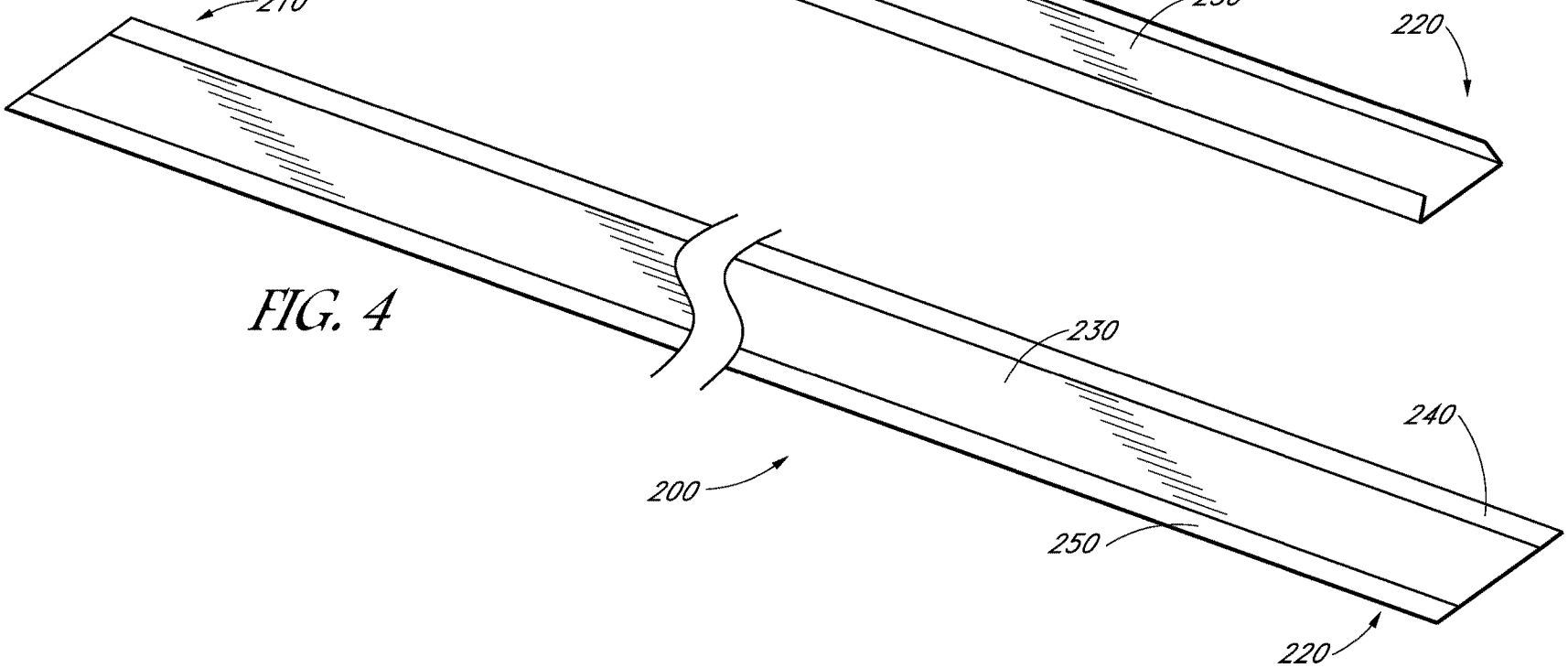
FIG. 4 is similar to FIG. 3 except that the seating flanges of the insert are folded flat.

FIGS. 3 and 4 are perspective views of an embodiment of an insert 200. The insert 200 is configured to extend the length of the door frame. In some embodiments, the insert 200 is a continuous piece. The insert 200 has a first end 210, a second end 220, a base 230, a first seating flange 240, and a second seating flange 250. In some embodiments, the first seating flange 240 and/or the second seating flange 250 are foldable and can be folded flat, as shown in FIG. 4. In some embodiments, the first seating flange 240 and/or the second seating flange 250 may extend away from the base 230 of the insert 200, as shown in FIG. 3. In some embodiments, creases provide an indication where the base 230 and the first and second flanges 240, 250 meet.

The insert 200 may be constructed of an asphalt-, butyl-, or petroleum-based material. Exemplary materials for the insert 200 are sold by Fortifiber Building Systems Group Inc., Henry Company, and MFM Building Products Corp. In some embodiments, the material may have an adhesive backing. In some embodiments, the material is a flexible flashing material. In other embodiments, the insert 200 may be constructed of other materials having water-resistant or water-impermeable properties, for example, but not limited to, butyl rubber, polyvinylidene fluoride, and acrylics. In some embodiments, the insert 200 is constructed of one type of material. In other embodiments, the insert 200 is constructed of two or more types of materials.

In some embodiments, the insert 200 is an integral component. In other embodiments, the insert 200 is constructed of two or more components. In some embodiments, the insert 200 may be constructed by connecting one component to at least one other component. For example, the insert 200 may be constructed by applying a first piece of adhesive-backed material to the base 230 of the insert 200 such that the first piece partially overlaps a back edge of the base 230 of the insert 200 and creates the first vertical seating flange 240. In some embodiments, the first piece may not have an adhesive backing, but rather, is applied using a separate adhesive.

Figure 6:
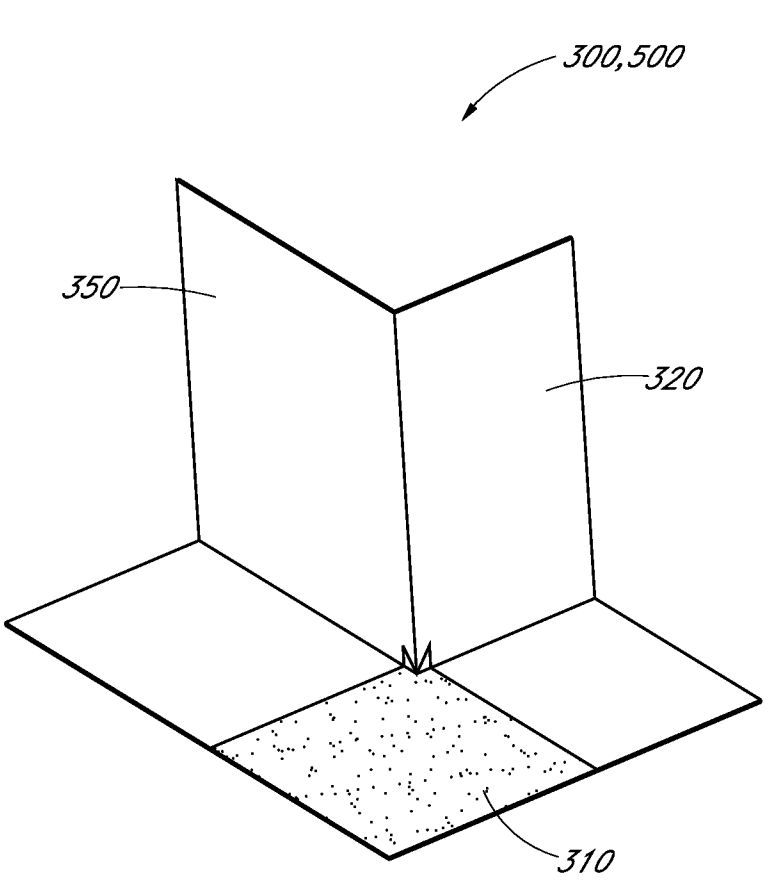
FIG. 6 is another perspective view of the corner member illustrated in FIG. 5.
Figure 5:
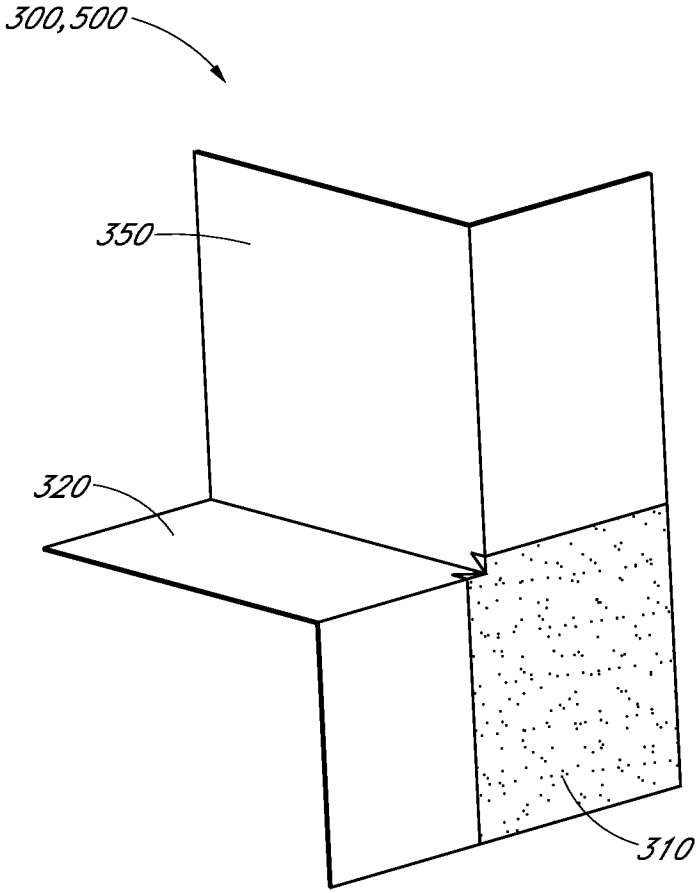
FIG. 5 is a perspective view of an embodiment of a corner member of the sill pan assembly.

FIGS. 5 and 6 are perspective views of an embodiment of a corner member 300 which may be configured as the first corner member 300 and the second corner member 500. In certain embodiments, the corner members 300, 500 are placed near a left and/or a right door stud (See FIGS. 11A-B, 13A, 13E, 13I, 13K). The corner member 300, 500 can also be placed at the opening to the pocket for the pocket door (See FIGS. 9A-D).

Figure 9B:
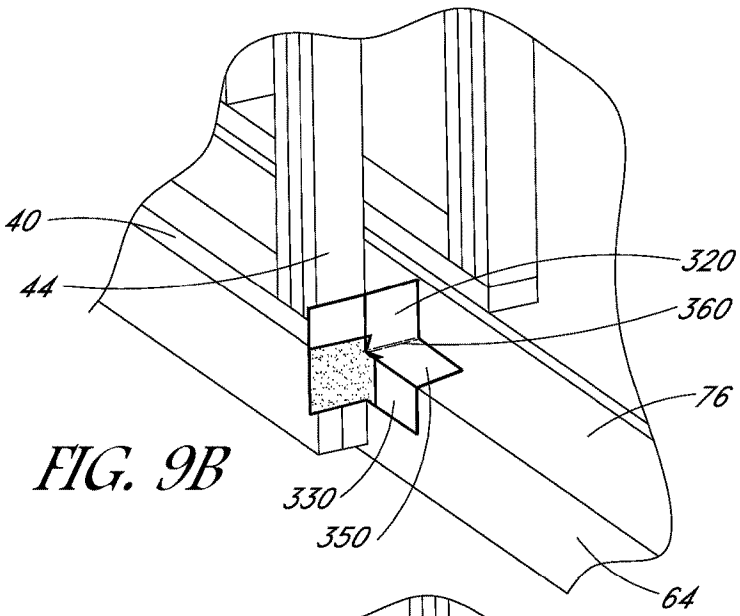
FIGS. 9A-D are close-up views of an embodiment of the placement of the first corner member at an entrance to the internal space in the building wall.
Figure 9D:
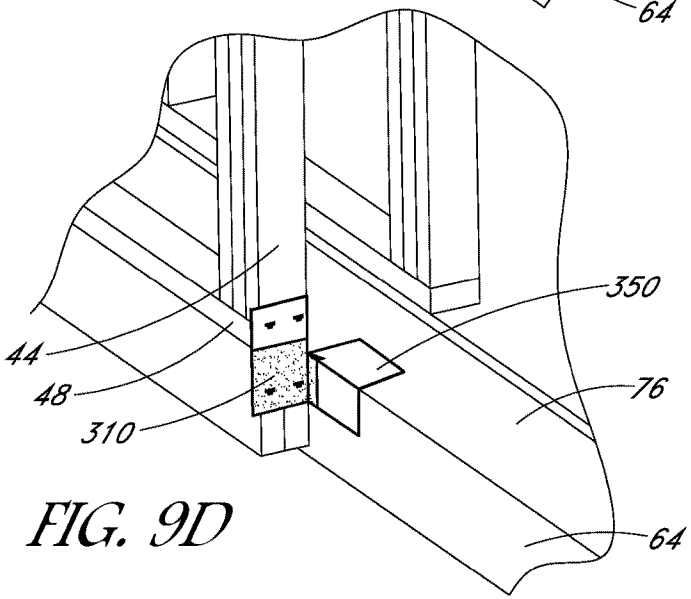

The corner member 300, 500 may have a first vertical seating flange 310 (see generally FIGS. 9A-D, 11B, 13A, 13E, 13I, and 13K for different orientations), a second vertical seating flange 320, and a horizontal seating flange 350. In certain embodiments, the first vertical seating flange 310 is configured to be secured to an end of a door stud, as shown in FIGS. 11B, 13A, 13E, 13I, and 13K. In certain embodiments, the first vertical seating flange 310 is configured to be secured to an end of an outer frame, as shown in FIGS. 9B-D.

The second vertical seating flange 320 and the horizontal seating flange 350 may be swapped depending on the desired orientation of the corner member 300, 500. For example, the second vertical seating flange 320 and the horizontal seating flange 350 may be swapped depending on whether the corner member 300, 500 is being placed on an outer frame on the left side of the door frame or on the right side of the door frame. Similarly, the second vertical seating flange 320 and the horizontal seating flange 350 may be swapped depending on whether the corner member 300, 500 is being placed on a left door stud or a right door stud. Further, the relative sizes of the second vertical seating flange 320 and the horizontal seating flange 350 can be changed from what is illustrated depending on the desired orientation of the corner member 300, 500.

The first vertical seating flange 310 may be folded so that portions of it contact or overlap other vertical surfaces. In some embodiments, the first vertical seating flange 310 may be folded so that portions of the first vertical seating flange 310 becomes a third vertical seating flange 330, as shown in FIGS. 9B-D, and a fourth vertical flange 340, as shown in FIG. 10C, and described in further detail below.

The corner member 300, 500 may be constructed of an asphalt-, butyl-, or petroleum-based material. Exemplary materials for the corner member 300, 500 are sold by Fortifiber Building Systems Group Inc., Henry Company, and MFM Building Products Corp. In some embodiments, the material may have an adhesive backing. In some embodiments, the material is a flexible flashing material. In other embodiments, the corner member 300, 500 may be constructed of other materials having water-resistant or water-impermeable properties, for example, but not limited to, butyl rubber, polyvinylidene fluoride, and acrylics. In some embodiments, the corner member 300, 500 is constructed of one type of material. In other embodiments, the corner member 300, 500 is constructed of two or more types of materials.

In some embodiments, the corner member 300, 500 is an integral component. In other embodiments, each corner member 300, 500 is constructed of two or more components. For example, the corner member 300, 500 may be constructed by connecting one component to at least one other component. In some embodiments, the corner member 300, 500 may be constructed by cutting one component and connecting at least one other component, which assists in creating the shape of the corner member 300, 500. For example, the solid white area of the corner member 300, as shown in FIGS. 5 and 6, may be a first component, and the patterned areas of the corner member 300 may be the other components.

In some embodiments, the corner member 300, 500 may be formed by applying a first piece of adhesive-backed material to a corner member 300, 500 such that the first piece partially overlaps a cut edge of the corner member and then applying a second piece of adhesive-backed material to the opposing side of the first piece, such that the first and second pieces connect to each other. In such an embodiment, the first and second pieces of adhesive-backed material may assist in making the corner member 300, 500. In some embodiments, the first and second pieces may not have an adhesive backing, but rather, are applied using a separate adhesive.

The malleability of the material used to construct the sill pan assembly pieces 100, 200, 300, 400, 500 is an aspect of the invention that allows the sill pan assembly to perform better than plastics. Plastics may be tough and semi-rigid so as to not bend. Plastics may become brittle and result in cracking or breakage in some environments, like wet or humid weather. The material used for embodiments of the sill pan assembly disclosed herein reduces the risk of cracking and breakage. Another aspect of the flexible material used to construct the end dams, inserts, and corner members, is that unlike metal, which can conduct heat, the material used here is not a good conductor of heat. Since the material used does not conduct heat well, this reduces the risk of condensation and damage to wood flooring, the subfloor, or inner/outer frames.

In some embodiments, the thickness of the material used to construct the end dams, insert, and/or corner members is about 25 mil. In some embodiments, the thickness of the material used is between 20 mil and 30 mil. In some embodiments, the thickness of the material used is between 23 mil and 27 mil. In some embodiments, the thickness of the material used is between 24.5 mil and 25.5 mil. In some embodiments, the thickness of the material used is 25 mil.

In some embodiments, one or more of the first and second end dams 100, 400 and the first and second corner members 300, 500 may be integral to the insert 200. Thus, embodiments of a sill pan assembly for an exterior door system such as pocket doors, stacking doors, French doors, and traditional sliding doors preferably includes from one to five pieces. Of course, the embodiments disclosed herein are not limited to the specified number of pieces. For example, certain pieces, such as the insert, can be made from more than one piece.

Figure 7:
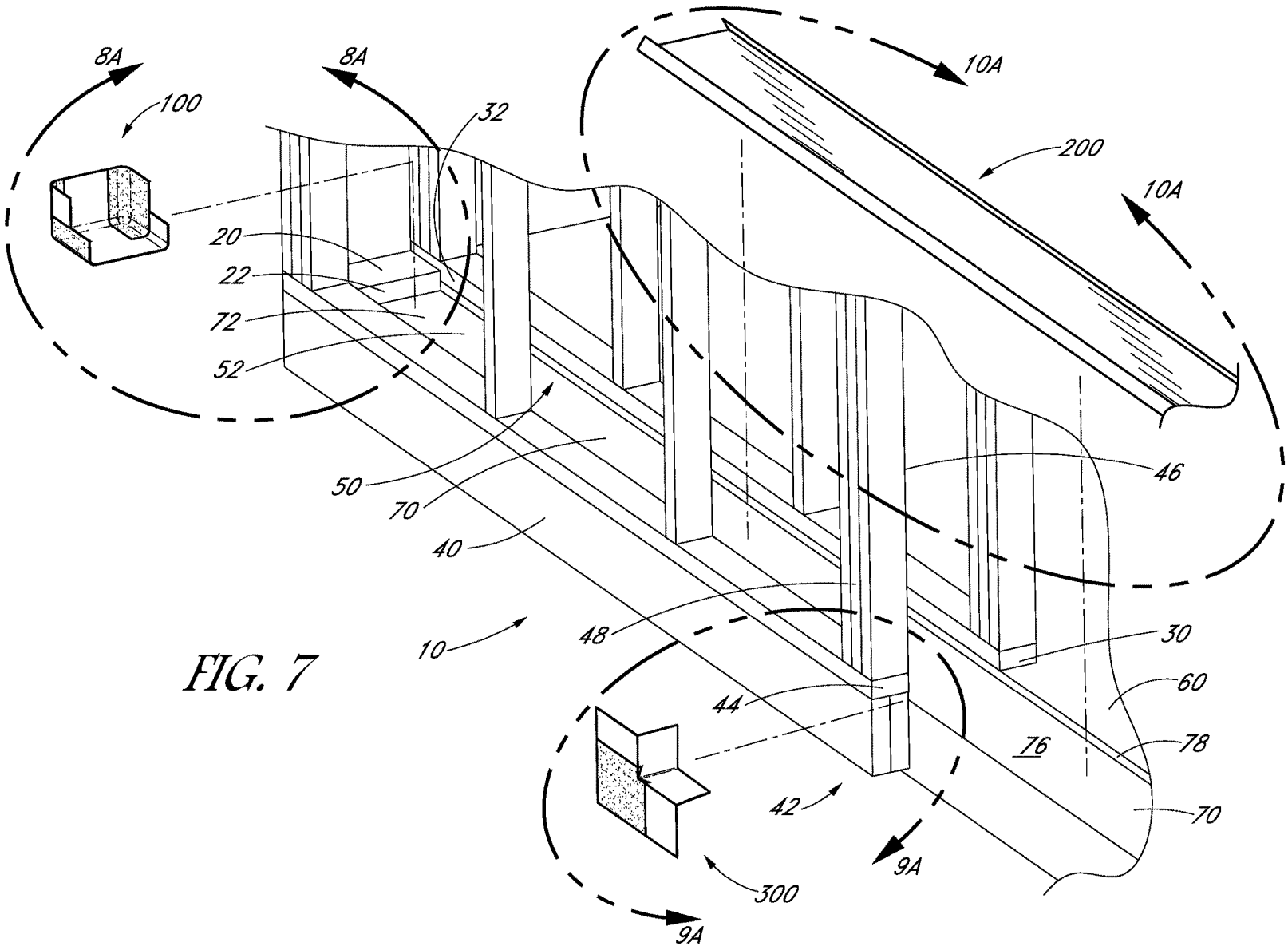
FIG. 7 is a perspective view of an embodiment of a framed building wall indicating locations for the placement of the first end dam, the insert, and the first corner member of the sill pan assembly within a channel of the building wall.

FIG. 7 is a perspective view of an embodiment of a building wall 10 and the placement of the first end dam 100, the insert 200, and the first corner member 300. The building wall 10 has a first or left door stud 20, an inner frame 30, and an outer frame 40. The first door stud 20 and the inner and outer frames 30, 40 define an internal space 50, which is configured to receive one or more panels of a pocket door. The first door stud 20 and the inner and outer frames 30, 40 further define an opening 52 in the internal space 50.

In the illustrated embodiment, the internal space 50 formed by the inner and outer frames 30, 40 is on the left side of the door as viewed in FIG. 7. Of course the disclosure is not so limited and can be employed with doors that have the inner and outer frames 30, 40 on the right side of the door (e.g., mirror image). Nothing in this disclosure is intended to limit application of the systems and methods disclosed herein to doors configured with the inner and outer frames 30, 40 only on the left side of the door.

An end 42 of the outer frame 40 has a generally vertical surface 44. The outer frame 40 further has a first vertical surface 46, which faces the internal space 50, and a second vertical surface 48, which faces towards the exterior of the building. The inner frame 30 has a first vertical surface 32, which faces the internal space 50. The first door stud 20 has a generally vertical surface 22.

The building wall 10 sits on the subfloor 60. The subfloor 60 has a channel 70, which runs from a first end 72 to a second end 74. The second end 74 may be near a right or second door stud 81, as shown in FIGS. 11A-12F, and described in more detail below. The channel 70 may have a horizontal surface 76 and a first vertical surface 78. The first vertical surface 78 of the channel 70 may be generally parallel with the vertical surface 32 of the inner frame 30. In some embodiments, the first vertical surface 78 of the channel 70 and the vertical surface 32 of the inner frame 30 meet so as to define a continuous vertical surface.

Figure 9A:
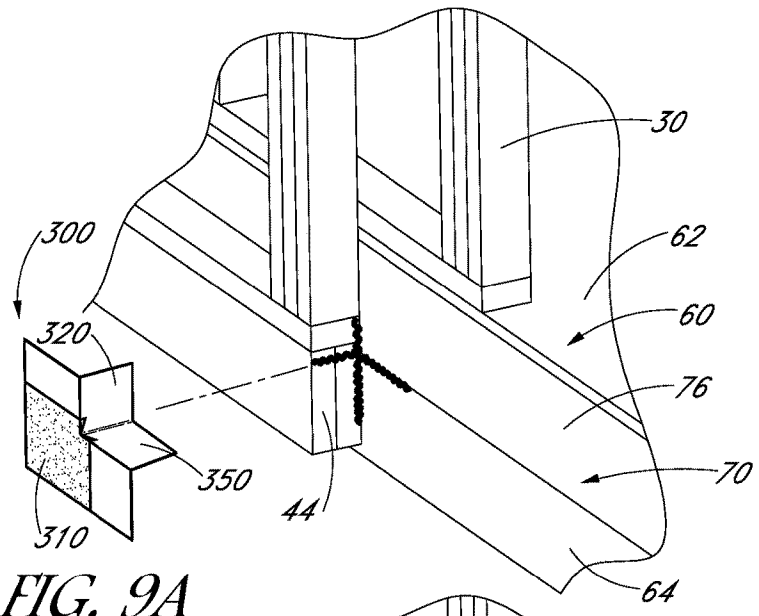
Figure 9C:
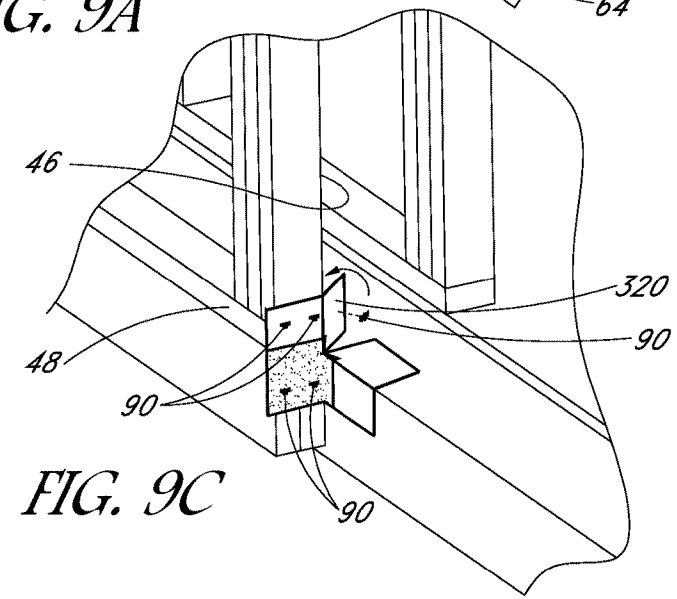

The subfloor 60 has a horizontal surface 62 and a first vertical surface 64 as is illustrated in FIG. 9A. The first vertical surface 64 of the subfloor 60 may be generally perpendicular to the vertical surface 44 of the end 42 of the outer frame 40. The first vertical surface 64 of the subfloor 60 may be generally parallel with the first vertical surface 78 of the channel 70.

Figure 8B:
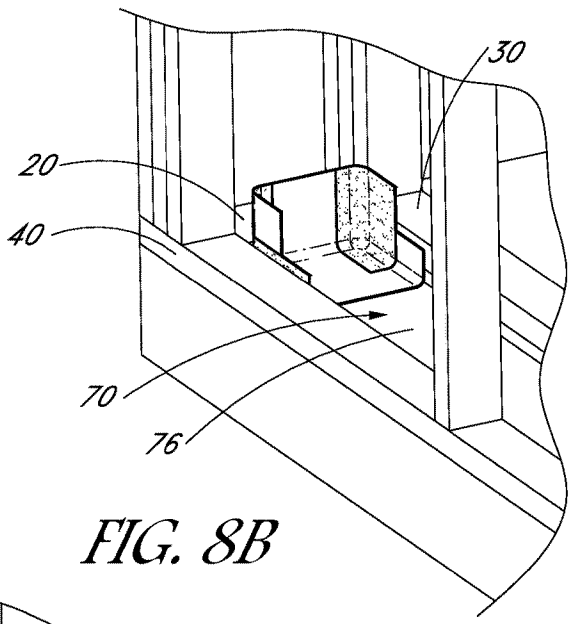
FIGS. 8A-C are close-up views of an embodiment of the placement of the first end dam within the building wall and specifically near a left door stud in an internal space that receives a pocket door.
Figure 8C:
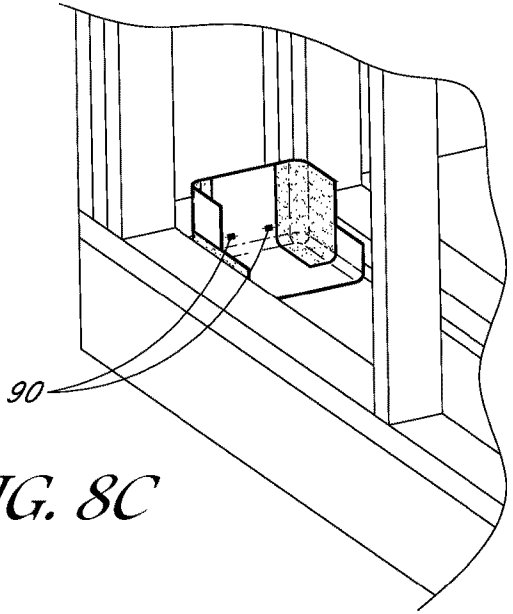
Figure 8A:
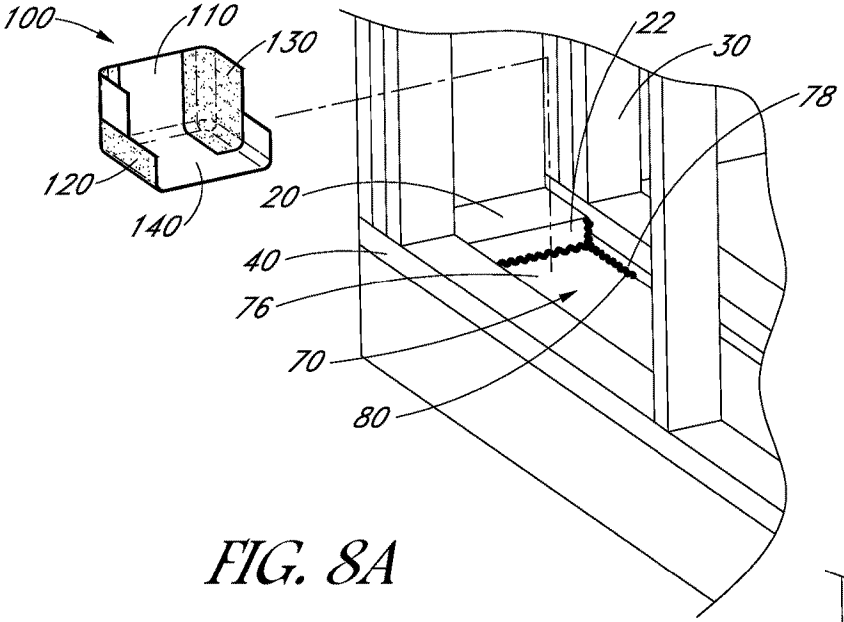

FIGS. 8A-C are close-up views of an embodiment of the placement of the first end dam 100 in the channel 70. In certain embodiments, the first end dam 100 is disposed against the generally vertical surface 22 of the first door stud 20 in the internal space 50.

FIG. 8A shows an embodiment of applying sealant 80 before placing the first end dam 100. In some embodiments, the sealant 80 is applied in a discontinuous method, for example, separate beads or lines. In some embodiments, a sealant is not applied. In some embodiments, the sealant 80 is applied to the first end dam 100 before installing the first end dam 100.

FIG. 8B shows the first end dam 100 placed on the applied sealant 80. The base 140 of the first end dam 100 contacts or overlaps the horizontal surface 76 of the channel 70. The first vertical seating flange 110 contacts the vertical surface 22 of the first door stud 20. The second vertical seating flange 120 contacts the first vertical surface 46 of the outer frame 40. The third vertical seating flange 130 contacts the first vertical surface 32 of the inner frame 30. Since the first end dam 100 is constructed of flexible material, it can easily be adjusted to fit rough openings or channels 70 with varying tolerances. During construction, the opening 52 and channel 70 defined partially by the first door stud 20, and the inner and outer frames 30, 40 may vary a certain degree from the measurements of the construction design. In some embodiments, the first end dam 100 is configured to accommodate variations in the sizes of the opening 52 and the channel 70. The first end dam 100 may fit a wider range of openings 52 and channels 70 than an end dam made from a non-flexible material. The flexible aspect of the first end dam 100 allows it to conform easily to oddly or irregularly shaped openings 52 and channels 70, while still providing a weather seal for the pocket door. The surfaces 110, 120, 130, 140 of the first end dam 100 can be bent and folded so as to contact irregular or oddly-shaped surfaces of the opening 52 and the channel 70.

FIG. 8C shows an embodiment of securing the first end dam 100 with one or more fasteners 90, such as staples. Other means for securing may be used. For example, in some embodiments, the first end dam 100 may be secured using nails, pins, screws, or adhesive. The material of the first end dam 100 provides self-sealing around the staples or other means for securing, thus maintaining the weather-tight seal for the pocket door. In some embodiments, a securing means is not used.

FIGS. 9A-D are close-up views of an embodiment of the placement of the corner member 300 on the outer frame 40 and the subfloor 60. FIG. 9A shows an embodiment of applying sealant 80 before placing the corner member 300. In some embodiments, the sealant 80 is applied in a discontinuous method, for example, separate beads or lines. In some embodiments, a sealant is not applied. In some embodiments, the sealant 80 may be applied to the corner member 300.

FIG. 9B shows an embodiment of placing the corner member 300 on the outer frame 40 and the subfloor 60. The first vertical seating flange 310 contacts the vertical surface 44 of the end 42 of the outer frame 40. The first vertical seating flange 310 may be folded so that the third vertical seating flange 330 contacts the first vertical surface 64 of the subfloor 60. In some embodiments, the corner member 300 may have a crease indicating where to fold the first vertical seating flange 310 and defining the third vertical seating flange 330.

In some embodiments, the corner member 300 does not have a crease indicating where to fold the first vertical seating flange 310. The horizontal seating flange 350 of the corner member 300 contacts the horizontal surface 76 of the channel 70 in the subfloor 60. As shown in FIG. 9B, the second vertical seating flange 320 may be parallel with the first vertical seating flange 310 and/or the vertical surface 44 of the end 42 of the outer frame 40. In some embodiments, there may be a crease defining the edge between the second vertical seating flange 320 and the first vertical seating flange 310. In some embodiments, there may not be a crease.

FIGS. 9C-D show an embodiment of wrapping the second vertical seating flange 320 around the end 42 of the outer frame 40 so that the second vertical seating flange 320 contacts the first vertical surface 46 of the outer frame 40, which faces the internal space 50. In some embodiments, the edge 360 between the horizontal seating flange 350 and the second vertical seating flange 320 of the corner member 300 is cut to allow the second vertical seating flange 320 to contact or overlap the first vertical surface 46 of the outer frame 40, as shown in FIG. 9C. In some embodiments, the corner member 300 may come pre-cut. In some embodiments, the corner member 300 is formed such that the horizontal seating flange 350 and the second vertical seating flange 320 are not connected so as to not need to be cut.

As shown in FIG. 9C, in certain embodiments, the first vertical seating flange 310 of the corner member 300 may be secured to the end 42 of the outer frame 40 using one or more fasteners 90, such as staples. The second vertical seating flange 320 may be secured to the outer frame 40 using one or more fasteners 90. In some embodiments, the corner member 300 is secured using nails, pins, screws, adhesive, or other securing means. The material of the corner member 300 provides self-sealing around the staples or other means for securing, thus maintaining the weather-tight seal for the door frame. In some embodiments, a securing means is not used.

As shown in FIG. 9D, a portion of the first vertical seating flange 310 may extend farther than the vertical surface 44 of the end 42 of the outer frame 40. As shown in FIG. 10C, this portion of the first vertical seating flange 310 may be folded to contact or overlap the second vertical surface 48 of the outer frame 40, defining a fourth vertical seating flange 340 of the corner member 300.

Figure 10A:
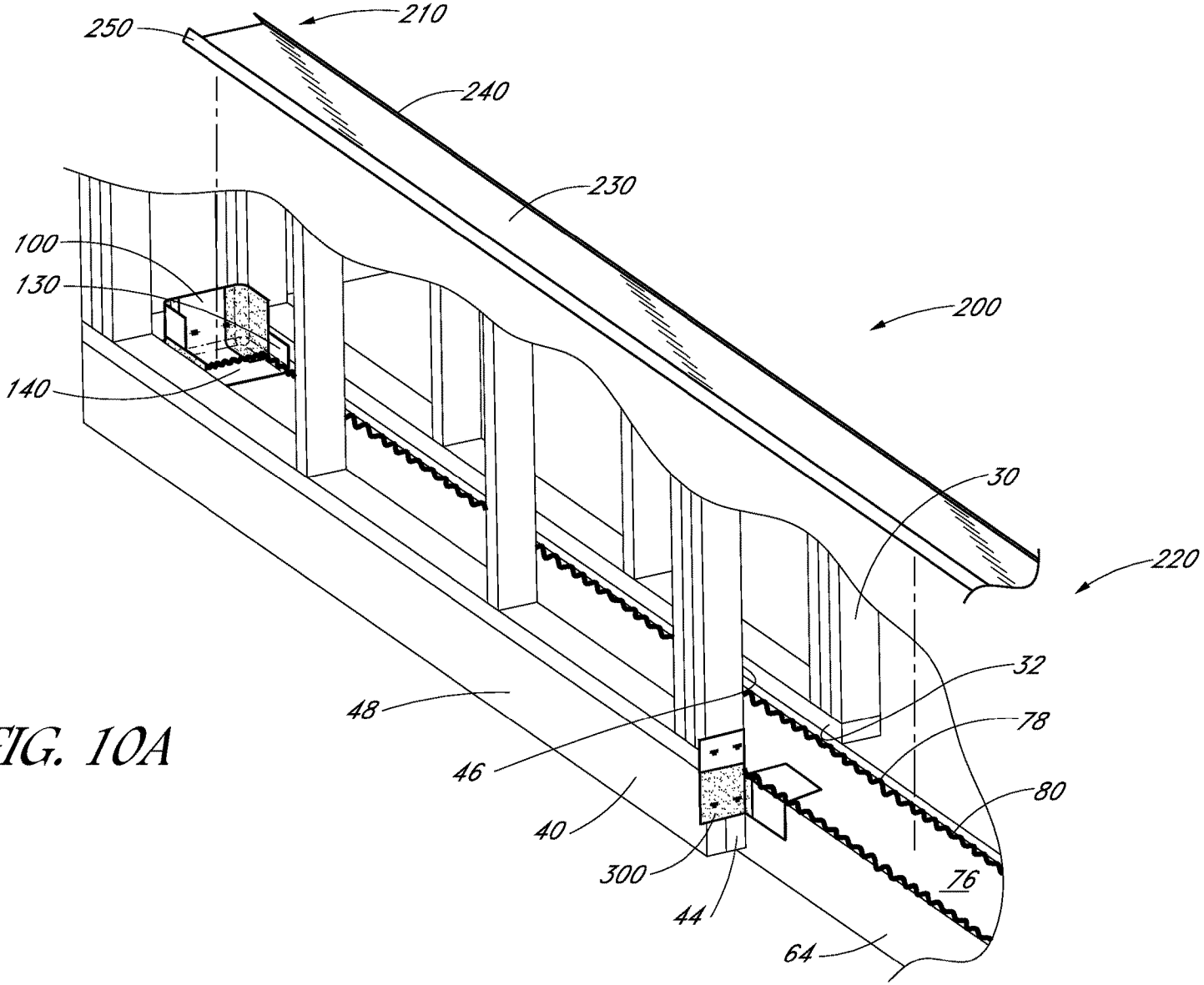
FIGS. 10A-C are close up views of an embodiment of the placement of a left side portion of the insert on the first end dam and along the channel in the building wall.
Figure 10B:
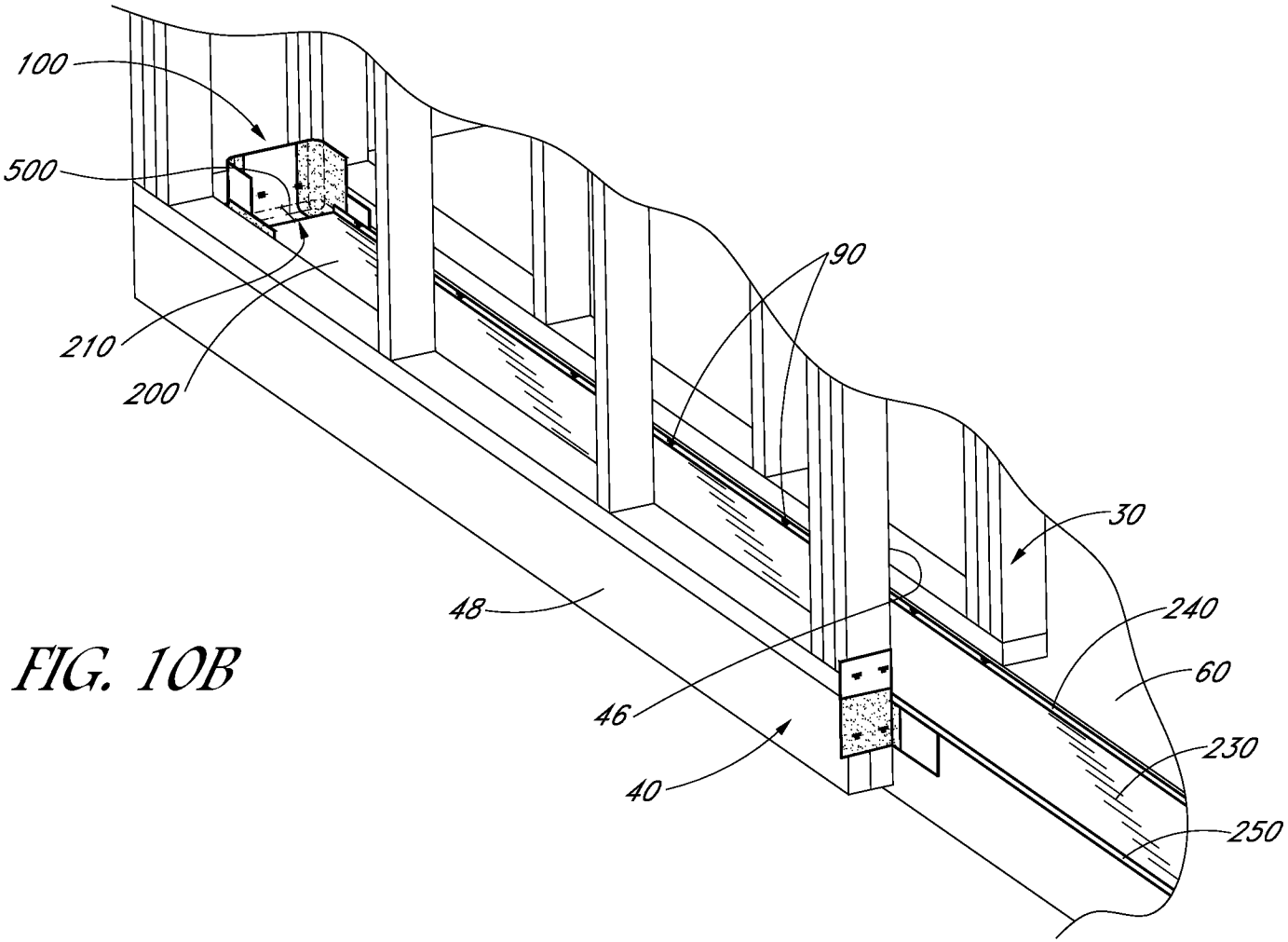
Figure 10C:
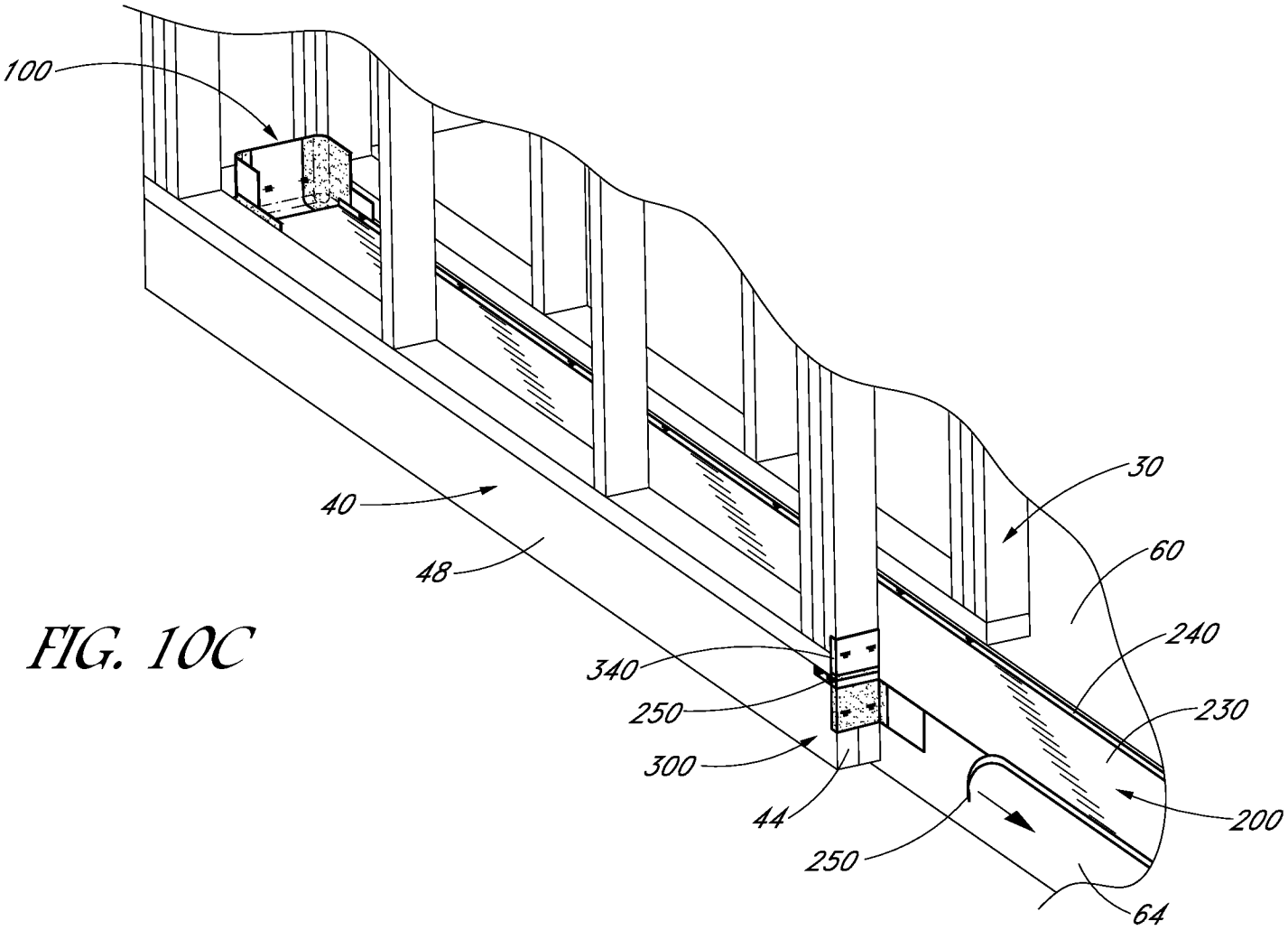

FIGS. 10A-C are close up views of an embodiment of the placement of the insert 200 along the channel 70 in the subfloor 60. FIG. 10A shows an embodiment of applying sealant 80 before placing the insert 200. As is illustrated in FIG. 10A, the sealant 80 is applied to the first end dam 100, 400, corner member 300, 500, and the channel 70. In some embodiments, the sealant 80 is applied in a discontinuous method, for example, separate beads or lines. In some embodiments, a sealant is not applied. In some embodiments, the sealant 80 may be applied to the insert 200.

FIG. 10B shows a first end 210 of the insert 200 positioned near the first end dam 100 and the first door stud 20. In some embodiments, the insert 200 is trimmed to fit the length of the channel 70. As shown in FIG. 10B, there may be a gap 500 between the first end 210 of the insert 200 and the first seating flange 110 of the first end dam 100. In some embodiments, there may be no gap 500. The base 230 of the insert 200 may partially overlap the base 140 of the first end dam 100 or vice versa. In some embodiments, the base 230 of the insert 200 completely covers the base 140 of the first end dam 100. In some embodiments, the base 230 of the insert 200 partially covers the base 140 of the first end dam 100 so that a portion of the base 140 of the first end dam 100 is exposed. The base 230 of the insert 200 contacts the horizontal surface 76 of the channel 70 in the subfloor 60.

As shown in FIG. 10B, the first vertical seating flange 240 of the insert 200 contacts or overlaps the first vertical surface 78 of the channel 70. In some embodiments, the first vertical seating flange 240 of the insert 200 may extend farther than the first vertical surface 78 of the channel 70. In some embodiments, a portion of the first vertical seating flange 240 of the insert 200 may contact or overlap the first vertical surface 32 of the inner frame 30. In some embodiments, any excess material of the first vertical seating flange 240 of the insert 200 may be removed, for example, by trimming the material. The first vertical seating flange 240 of the insert 200 may be secured using one or more fasteners 90, such as staples. Other means for securing may be used. For example, in some embodiments, the insert 200 may be secured using nails, pins, screws, or adhesive. The material of the insert 200 provides self-sealing around the staples or other means for securing, thus maintaining the weather-tight seal for the door frame. In some embodiments, a securing means is not used.

In some embodiments, a portion of the second vertical seating flange 250 of the insert 200 contacts or overlaps the first vertical surface 46 of the outer frame 40. In some embodiments, the portion of the insert 200 that contacts or overlaps the first vertical surface 46 of the outer frame 40 is the portion that extends through the internal space 50. In some embodiments, a portion of the second vertical seating flange 250 of the insert 200 that does not extend through the internal space 50 is removed, as shown in FIG. 10C. In some embodiments, the portion of the second vertical seating flange 250 that extends across the threshold is folded down and contacts or overlaps the first vertical surface 64 of the subfloor 60, as shown in FIG. 12E. In some embodiments, a portion of the second vertical seating flange 250 of the insert 200 is wrapped around the end 42 of the outer frame 40. The second vertical seating flange 250 may contact or overlap the first seating flange 310 of the corner member 300, 500 and wrap around to contact or overlap the second vertical surface 48 of the outer frame 40 and the fourth vertical seating flange 340 of the corner member 300, 500.

Figure 11B:
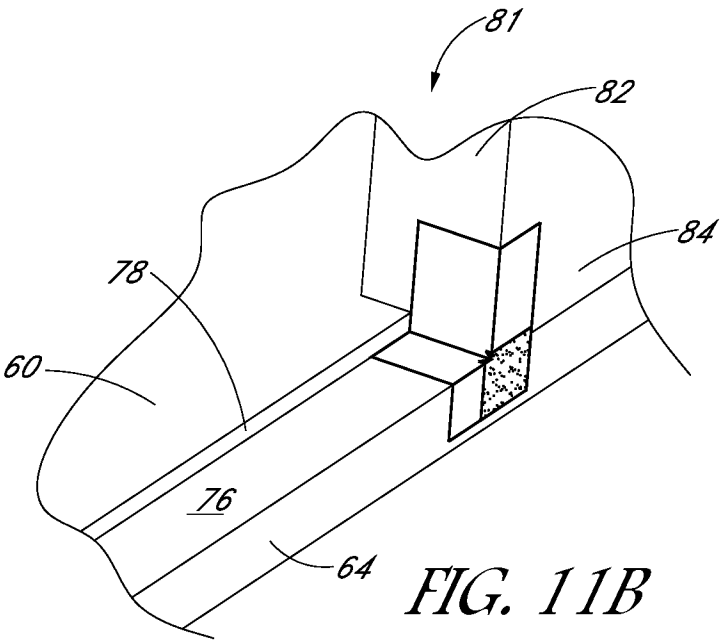
FIGS. 11A-B are close-up views of an embodiment of the placement of a second corner member, specifically near a right door stud that is located at an opposite end of the threshold of the framed building wall shown in FIG. 7.
Figure 11A:
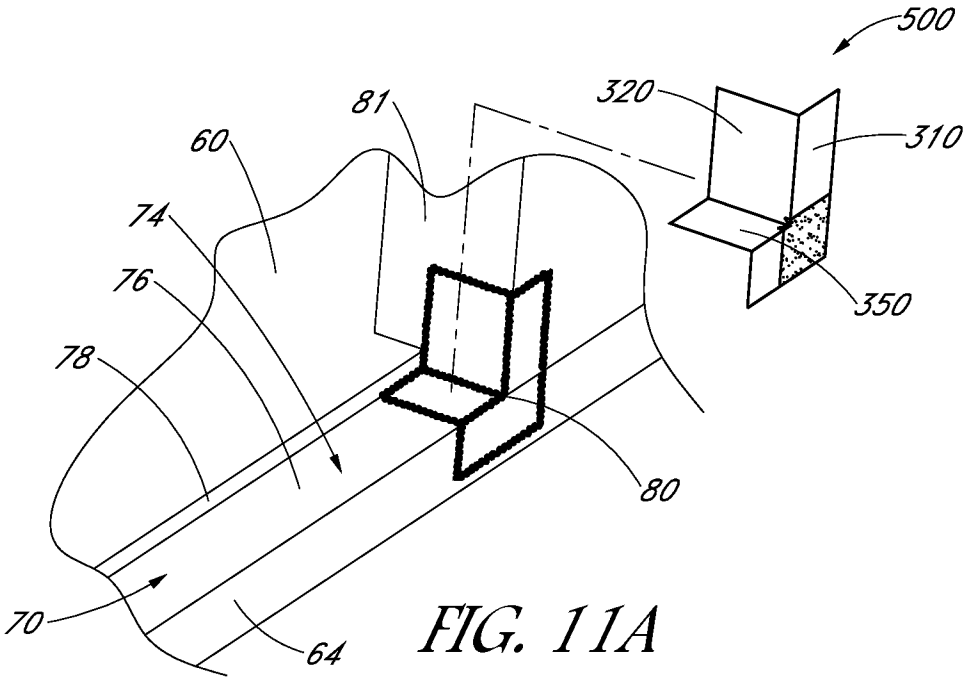

FIGS. 11A-B are close-up views of an embodiment of the placement of a second corner member 500, specifically near a right door stud 81 that is located at an opposite end of the threshold of the framed building wall shown in FIG. 7.

FIG. 11A shows an embodiment of applying sealant 80 before placing the second corner member 500. In some embodiments, the sealant 80 is applied in a discontinuous method, for example, separate beads or lines. In some embodiments, a sealant 80 is not applied. In some embodiments, the sealant 80 may be applied to the corner member 500.

FIG. 11B shows an embodiment of placing the second corner member 500 near the second door stud 81. In certain embodiments, at least a portion of the second corner member 500 is disposed against the second door stud 81. As is illustrated in FIG. 11B, the second door stud 81 is not located in an internal space but instead is in the doorway of the pocket door. At least a portion of the second corner member 500 is placed in the channel 70.

As is illustrated in FIGS. 5 and 6, the second corner member 500 is similar to the first corner member 300. In certain embodiments, the second corner member 500 is a mirror image of the first corner member 300 and vice versa. In certain embodiments, a final configuration of the second corner member 500 after installation can be different depending on the type of door system and whether the corner member 300, 500 is secured to an end of a door stud, as shown in FIGS. 11B, 13A, 13E, 13I, and 13K, or to an end of an outer frame, as shown in FIGS. 9B-D. Further, the corner member 300, 500 can be a mirror image of the corner member illustrated in FIGS. 9B-D. For example, the corner member 300, 500 can be a mirror image of the corner member 300 illustrated in FIGS. 9B-D when the internal space 50 formed by the inner and outer frames 30, 40 is on the right side of the door. FIGS. 9B-D illustrate the internal space 50 formed by the inner and outer frames 30, 40 being on the left side of the door. Accordingly, the disclosure is not so limited and can be employed with doors that have the inner and outer frames 30, 40 on the left side or right side of the door (e.g., mirror image). Nothing in this disclosure is intended to limit application of the systems and methods disclosed herein to doors configured with the inner and outer frames 30, 40 on only one side of the door.

The corner member 500 may have a first vertical seating flange 310, a second vertical seating flange 320, and a horizontal seating flange 350. In certain embodiments, the first vertical seating flange 310 is configured to be secured to an end of the door stud 81, as shown in FIGS. 11A-B, 13A, and 13E. For example, the first vertical sealing flange 310 can be secured against the second vertical surface 84. The second vertical seating flange 320 can be secured against the first vertical surface 82. In certain embodiments, the horizontal seating flange 350 is secured against the horizontal surface 76 of the channel 70.

The second vertical seating flange 320 and the horizontal seating flange 350 may be swapped depending on whether the corner member 500 is being placed on a left door stud or a right door stud. For example, the second corner member 500 can be rotated 180 degrees about an axis defined by an intersection of the second vertical seating flange 320 with the horizontal seating flange 350 to place the corner member 500 against a door stud on the opposite side of the door opening from the second door stud 81. For example, the second corner member 500 can be a mirror image about any of the surfaces or flanges of the corner member 500 depending on the desired installed orientation.

The corner member 500 may be constructed of an asphalt-, butyl-, or petroleum-based material. Exemplary materials for the corner member 500 are sold by Fortifiber Building Systems Group Inc., Henry Company, and MFM Building Products Corp. In some embodiments, the material may have an adhesive backing. In some embodiments, the material is a flexible flashing material. In other embodiments, the corner member 500 may be constructed of other materials having water-resistant or water-impermeable properties, for example, but not limited to, butyl rubber, polyvinylidene fluoride, and acrylics. In some embodiments, the corner member 500 is constructed of one type of material. In other embodiments, the corner member 500 is constructed of two or more types of materials.

In some embodiments, the corner member 500 is an integral component. In other embodiments, the corner member 500 is constructed of two or more components. For example, the corner member 500 may be constructed by connecting one component to at least one other component. In some embodiments, the corner member 500 may be constructed by cutting one component and connecting at least one other component, which assists in creating the shape of the corner member 500. For example, the solid white area of the corner member 500, as shown in FIGS. 11A and 11B, may be a first component, and the patterned areas of the corner member 500 may be the other components.

In some embodiments, the corner member 500 may be formed by applying a first piece of adhesive-backed material to a corner member 500 such that the first piece partially overlaps a cut edge of the corner member and then applying a second piece of adhesive-backed material to the opposing side of the first piece, such that the first and second pieces connect to each other. In such an embodiment, the first and second pieces of adhesive-backed material may assist in making the corner member 500. In some embodiments, the first and second pieces may not have an adhesive backing, but rather, are applied using a separate adhesive.

Figure 12B:
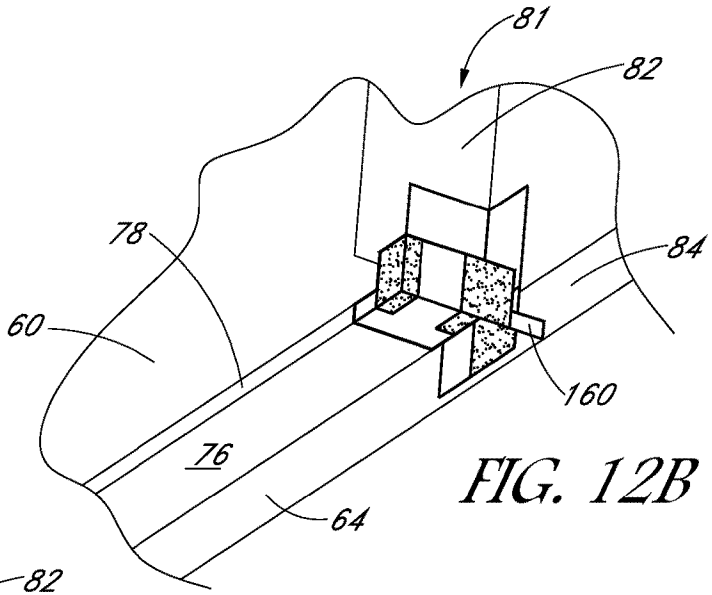
FIGS. 12A-C are close-up views of the right door stud of the threshold illustrated in FIGS. 11A-B showing the placement of a second end dam, specifically on the second corner member illustrated in FIGS. 11A-B.
Figure 12A:
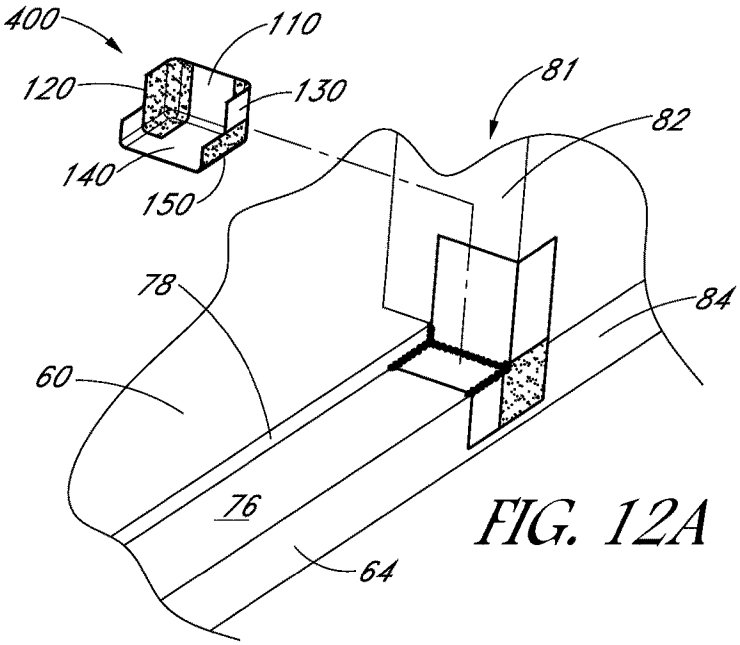
Figure 12C:
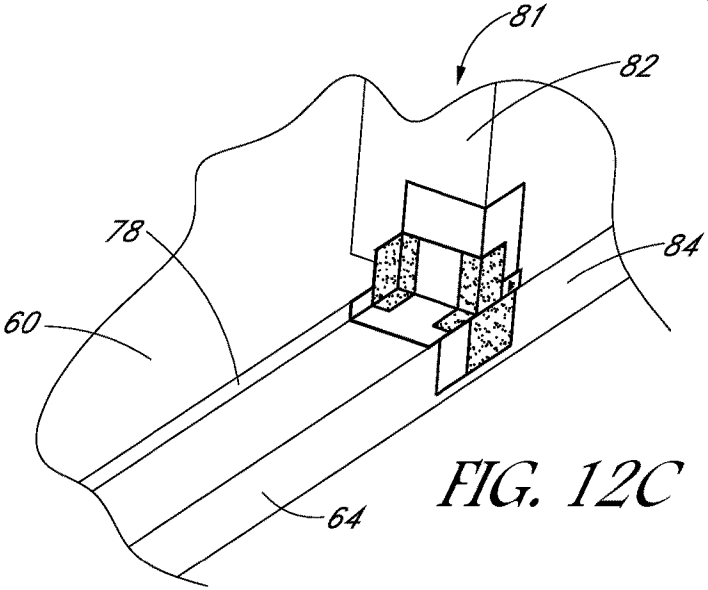
Figure 12E:
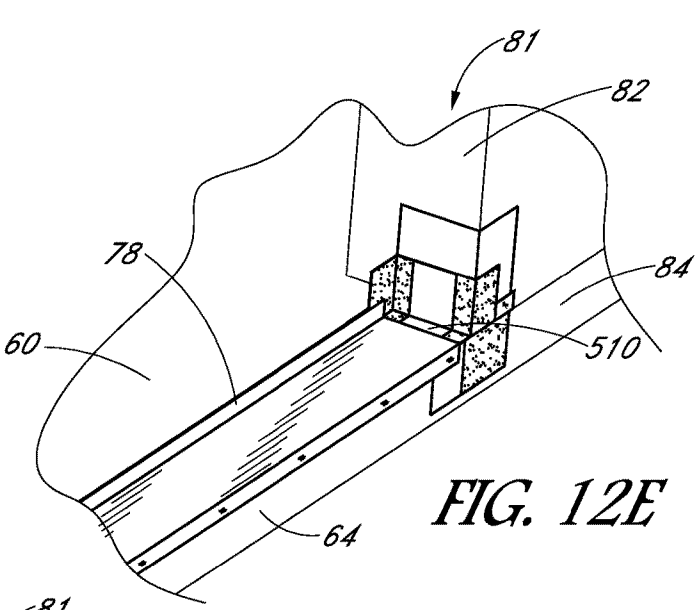
FIGS. 12D-F are close-up views of the right door stud of the threshold illustrated in FIGS. 11A-B showing a right side portion of the insert from FIG. 10A being placed on the horizontal surface and the second end dam member.

FIGS. 12A-C are close-up views of the right door stud of the threshold illustrated in FIGS. 11A-B showing the placement of a second end dam 400, specifically on the second corner member 500 illustrated in FIGS. 11A-B. In certain embodiments, the second end dam 400 is disposed on the second corner member 500 which itself is against the second door stud 81. The second door stud 81 is not located in an internal space but instead is in the doorway. The second end dam 400 has a first vertical seating flange 110, a second vertical seating flange 120, a third vertical seating flange 130, and a base 140. The second end dam 400 is placed at the second end 74 of the channel 70. The second door stud 81 has a first vertical surface 82 and a second vertical surface 84. The first vertical surface 82 is generally perpendicular to the horizontal surface 76 of the channel 70.

FIG. 12A shows an embodiment of applying sealant 80 before placing the second end dam 400. In some embodiments, the sealant 80 is applied in a discontinuous method, for example, separate beads or lines. In some embodiments, a sealant is not applied. In some embodiments, the sealant 80 may be applied to the second end dam 400.

FIG. 12B shows an embodiment of placing the second end dam 400 on the second corner member 500 near the right door stud 81. The second end dam 400 is disposed at the second end 74 of the channel 70. In certain embodiments, the base 140 of the second end dam 400 contacts or overlaps at least a portion of the horizontal seating flange 350 of the second corner member 500. In certain embodiments, the base 140 of the second end dam 400 contacts or overlaps at least a portion of the horizontal surface 76 of the channel 70. In certain embodiments, the base 140 of the second end dam 400 contacts or overlaps at least a portion of the horizontal seating flange 350 of the second corner member 500 and at least a portion of the horizontal surface 76 of the channel 70.

In certain embodiments, the first vertical seating flange 110 of the second end dam 400 contacts or overlaps at least a portion of the second vertical seating flange 320 of the second corner member 500. In certain embodiments, the first vertical seating flange 110 of the second end dam 400 contacts or overlaps at least a portion of the first vertical surface 82 of the second door stud 81. In certain embodiments, the first vertical seating flange 110 of the second end dam 400 contacts or overlaps at least a portion of the second vertical seating flange 320 of the second corner member 500 and at least a portion of the first vertical surface 82 of the second door stud 81.

In certain embodiments, at least a portion of the second vertical seating flange 120 of the second end dam member 400 contacts or overlaps the vertical surface 78 of the channel 70 in the subfloor 60. In some embodiments, the edge 150 between the base 140 and the third vertical seating flange 130 is trimmed to allow the third vertical seating flange 130 to contact or overlap at least a portion of the first vertical seating flange 310 of the corner member 500, as shown in FIG. 12B. In some embodiments, the edge 150 between the base 140 and the third vertical seating flange 130 is trimmed to allow the third vertical seating flange 130 to contact or overlap at least a portion of the first vertical surface 82 of the second door stud 81. In some embodiments, the edge 150 between the base 140 and the third vertical seating flange 130 is trimmed to allow the third vertical seating flange 130 to contact or overlap at least a portion of the first vertical seating flange 310 of the corner member 500 and at least a portion of the first vertical surface 82 of the second door stud 81.

In some embodiments, the second end dam 400 may come pre-cut. In some embodiments, the end dam 400 is formed such that the base 140 and the third vertical seating flange 130 are not connected so as to not need to be cut. In such embodiments, the second end dam 400 may have a first vertical flange 110, a second vertical flange 120, and a base 140.

FIG. 12C shows an embodiment where a portion 160 of the second end dam 400 placed in FIG. 12B has been wrapped around the second corner member 500 and the right door stud 81 of the building wall. In certain embodiments, the portion 160 of the third vertical flange 130 contacts or overlaps at least a portion of the first vertical seating flange 310 of the corner member 500. In certain embodiments, the portion 160 of the third vertical flange 130 contacts or overlaps at least a portion of the second vertical surface 84 of the door stud 81. The portion 160 may be secured using one or more staples 90. Other means for securing may be used. For example, in some embodiments, the second end dam 400 may be secured using nails, pins, screws, or adhesive. The material of the second end dam 400 provides self-sealing around the staple 90 or other means for securing, thus maintaining the weather-tight seal for the door. In some embodiments, a securing means is not used. In some embodiments, the third vertical seating flange 130 does not extend further than the second vertical seating flange 320 of the second corner member 500.

Figure 12F:
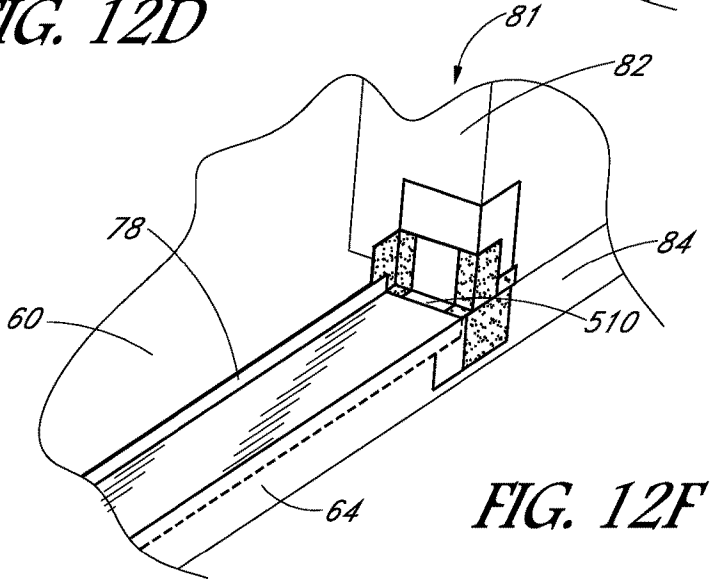
Figure 12D:
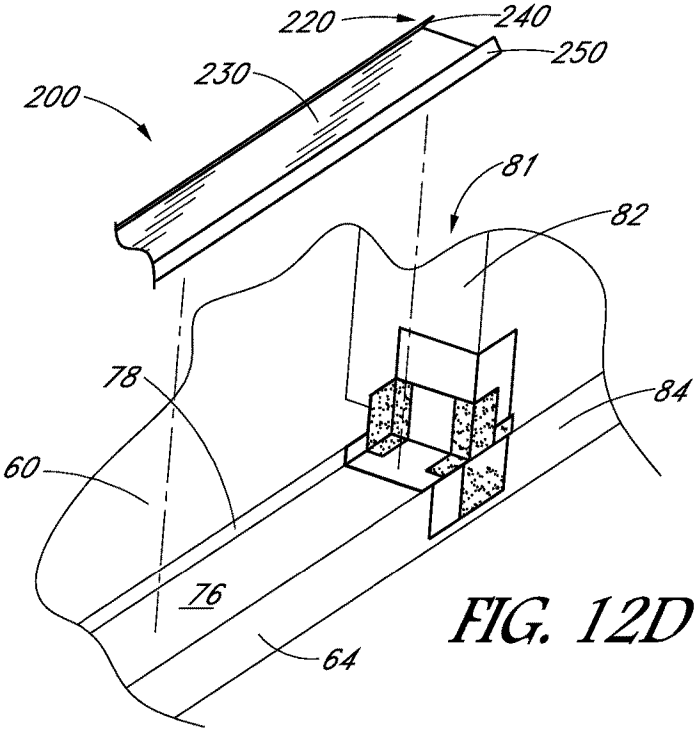

FIGS. 12D-F are close-up views of the right door stud 81 of the threshold illustrated in FIGS. 11A-B showing a right side portion of the insert 200 from FIG. 10A being placed on the horizontal surface 76 and on at least a portion of the second end dam member 400. For example, FIG. 12D shows an embodiment of the insert 200 aligned with the horizontal surface 76 and the second end dam 400. In certain embodiments, the right side portion of the insert 200 from FIG. 10A is placed on at least a portion of the horizontal seating flange 350 of the second corner member 500. In certain embodiments, the second end 220 of the insert 200 is placed in the second end 74 of the channel 70 in the subfloor 60.

As shown in FIG. 12E-F, in some embodiments, the second end 220 of the insert 200 is positioned near the second end dam 400 and the second door stud 81 so that there is a gap 510 between the second end 220 of the insert 200 and the first vertical seating flange 110 of the second end dam 400. In some embodiments, there is no gap 510. In some embodiments, the second end 220 of the insert 200 abuts the first vertical seating flange 110 of the second end dam 400. The base 230 of the insert 200 may partially overlap the base 140 of the second end dam 400 or vice versa. In some embodiments, the base 230 of the insert 200 completely covers the base 140 of the second end dam 400. In some embodiments, the base 230 of the insert 200 partially covers the base 140 of the second end dam 400 so that a portion of the base 140 of the second end dam 400 is exposed. In some embodiments, the base 230 of the insert 200 may partially overlap the horizontal seating flange 350 of the second corner member 500. The base 230 of the insert 200 contacts or overlaps at least a portion of the horizontal surface 76 of the channel 70 in the subfloor 60.

In certain embodiments, sealant 80 is applied to the horizontal surface 76 and the second end dam 400 before placement of the insert 200. In some embodiments, the sealant 80 is applied in a discontinuous method, for example, separate beads or lines. In some embodiments, a sealant is not applied. In some embodiments, the sealant 80 is applied to the insert 200 before installing the insert 200.

FIG. 12E shows an embodiment of wrapping a portion of the insert 200 around the edge of the subfloor 60. As shown in FIG. 12E, in some embodiments, the portion of the second vertical seating flange 250 that extends across the threshold is folded down and contacts or overlaps the first vertical surface 64 of the subfloor 60.

FIG. 12F shows an alternate embodiment to FIG. 12E where the portion of the insert 200 is removed instead of being wrapped around the edge of the subfloor 60. As shown in FIG. 12F, in some embodiments a portion of the second vertical seating flange 250 of the insert 200 is removed. In some embodiments, the insert 200 may not have a second vertical seating flange 250. In some embodiments, the second vertical seating flange 250 may extend partially along the length of the insert 200.

FIGS. 7-12F show the installation of the first and second end dams 100, 400, insert 200, and first and second corner members 300, 500 for a pocket door where the door is stowed in the left side of the door frame. From this, one skilled in the art would understand how to adjust the installation of the first and second end dams 100, 400, insert 200, and the first and second corner members 300, 500 for a pocket door where the door is stowed in the right side of the door frame.

Figure 13B:
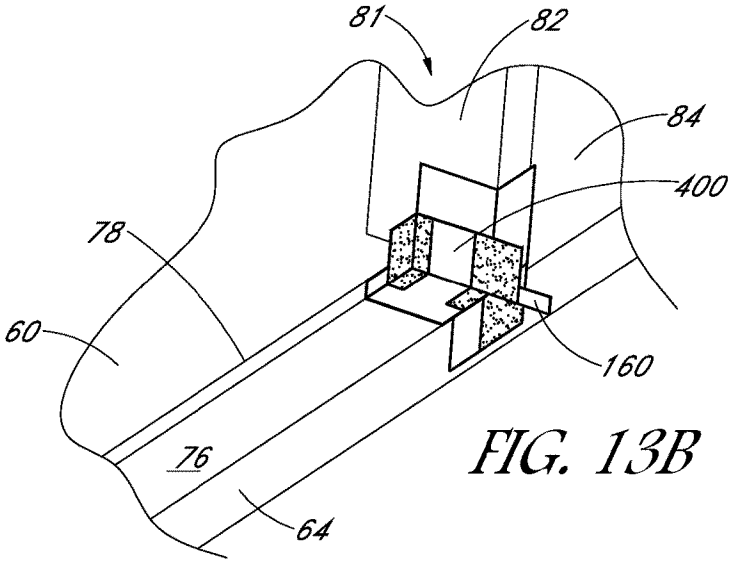
FIGS. 13A-D are close-up views of an exemplary right door stud of a recessed threshold for a door system, such as stacking doors, French doors, or traditional sliding doors. While not shown in FIGS. 13A-D.
Figure 13D:
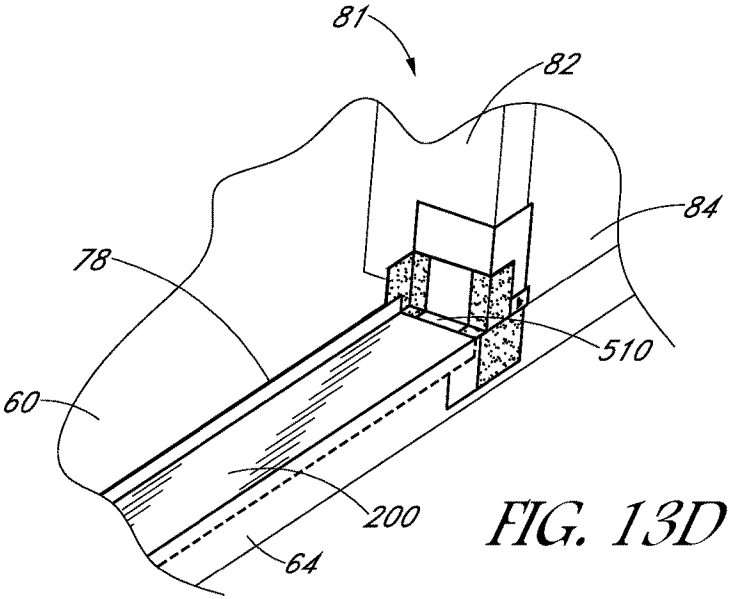
Figure 13A:
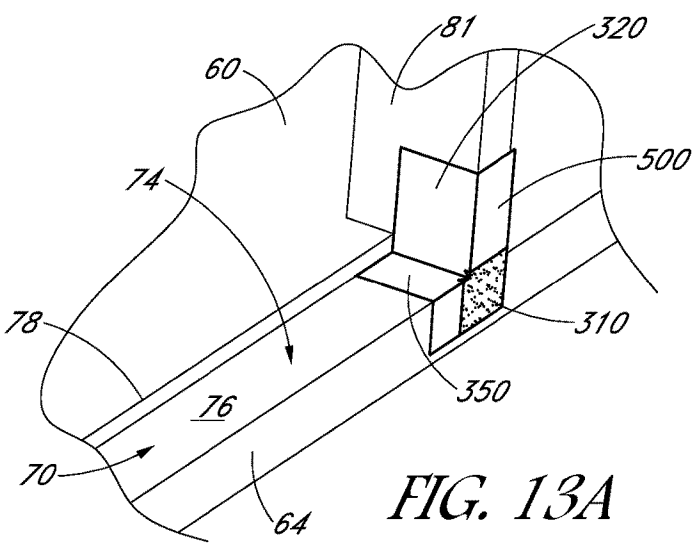

FIGS. 13A-D are close-up views of an exemplary right door stud 81 of a recessed threshold for a door system, such as stacking doors, French doors, or traditional sliding doors. While not shown in FIGS. 13A-D, FIG. 13I shows both the right door stud 81 and the left door stud 20 of the recessed threshold with corners members 300, 500 installed. The left door stud 20 is a mirror image of the right door stud 81. Similarly, the installation of the door system in the regions of the right door stud 81 and the left door stud 20 is the same besides being a mirror image. FIG. 13A shows an embodiment of placing the corner member 500 near the right door stud 81. In certain embodiments, at least a portion of the corner member 500 is disposed against the second door stud 81. As is illustrated in FIG. 13A, the second door stud 81 is on a right side of the doorway. At least a portion of the corner member 500 is placed in the channel 70.

The corner member 500 may have a first vertical seating flange 310, a second vertical seating flange 320, and a horizontal seating flange 350. In the illustrated embodiment, the first vertical seating flange 310 of the corner member 500 is configured to be secured to an end of the door stud 81. For example, the first vertical sealing flange 310 can be secured against the second vertical surface 84. The second vertical seating flange 320 can be secured against the first vertical surface 82. In certain embodiments, the horizontal seating flange 350 is secured against the horizontal surface 76 of the channel 70.

In certain embodiments, the second vertical seating flange 320 and the horizontal seating flange 350 may be swapped depending on whether the corner member 500 is being placed on the first door stud 20 or the second door stud 81. In certain embodiments, the corner member 500 illustrated in FIG. 13A can be rotated 180 degrees about an axis defined by an intersection of the second vertical seating flange 320 with the horizontal seating flange 350 to place the corner member 500 against the door stud 20 illustrated in FIG. 13I. In certain embodiments, the corner member 300 illustrated in FIG. 13I can be a mirror image about any of the surfaces or flanges of the corner member 500 illustrated in FIG. 13A depending on the desired installed orientation.

In certain embodiments, each of the corner members 300, 500 is a separate piece from the sill pan assembly. In certain other embodiments, each of the corner members 300, 500 is integral to (e.g., monolithic construction) the sill pan assembly. For example, embodiments of the sill pan assembly installed with two corner members 300, 500 can include one monolithic piece. Of course, the embodiments disclosed herein are not limited to a specific number of pieces.

In certain embodiments, sealant 80 is applied before placing the corner member 500. In some embodiments, the sealant 80 is applied in a discontinuous method, for example, separate beads or lines. In some embodiments, a sealant 80 is not applied. In some embodiments, the sealant 80 may be applied to the corner member 500.

FIG. 13B shows an embodiment of placing an end dam 400 on the corner member 500 near the right door stud 81 prior to wrapping a portion 160 of the end dam 400 around the corner member 500 and the right door stud 81 of the building wall. The end dam 400 is disposed at the second end 74 of the channel 70. In certain embodiments, the base 140 of the end dam 400 contacts or overlaps at least a portion of the horizontal seating flange 350 of the corner member 500. In certain embodiments, the base 140 of the end dam 400 contacts or overlaps at least a portion of the horizontal surface 76 of the channel 70. In certain embodiments, the base 140 of the end dam 400 contacts or overlaps at least a portion of the horizontal seating flange 350 of the corner member 500 and at least a portion of the horizontal surface 76 of the channel 70.

In certain embodiments, the first vertical seating flange 110 of the end dam 400 contacts or overlaps at least a portion of the second vertical seating flange 320 of the corner member 500. In certain embodiments, the first vertical seating flange 110 of the end dam 400 contacts or overlaps at least a portion of the first vertical surface 82 of the second door stud 81. In certain embodiments, the first vertical seating flange 110 of the end dam 400 contacts or overlaps at least a portion of the second vertical seating flange 320 of the corner member 500 and at least a portion of the first vertical surface 82 of the second door stud 81.

In certain embodiments, at least a portion of the second vertical seating flange 120 of the end dam member 400 contacts or overlaps the vertical surface 78 of the channel 70 in the subfloor 60. For example, as is illustrated in FIGS. 13A-D, the vertical surface 78 is formed by recessing the horizontal surface 76 of the channel 70 below the subfloor 60.

In some embodiments, the edge 150 between the base 140 and the third vertical seating flange 130 is trimmed to allow the third vertical seating flange 130 to contact or overlap at least a portion of the first vertical seating flange 310 of the corner member 500, as shown in FIG. 13B. In some embodiments, the edge 150 between the base 140 and the third vertical seating flange 130 is trimmed to allow the third vertical seating flange 130 to contact or overlap at least a portion of the first vertical surface 82 of the second door stud 81. In some embodiments, the edge 150 between the base 140 and the third vertical seating flange 130 is trimmed to allow the third vertical seating flange 130 to contact or overlap at least a portion of the first vertical seating flange 310 of the corner member 500 and at least a portion of the first vertical surface 82 of the second door stud 81.

In some embodiments, the end dam 400 may come pre-cut. In some embodiments, the end dam 400 is formed such that the base 140 and the third vertical seating flange 130 are not connected so as to not need to be cut. In such embodiments, the end dam 400 may have a first vertical flange 110, a second vertical flange 120, and a base 140.

Figure 13C:
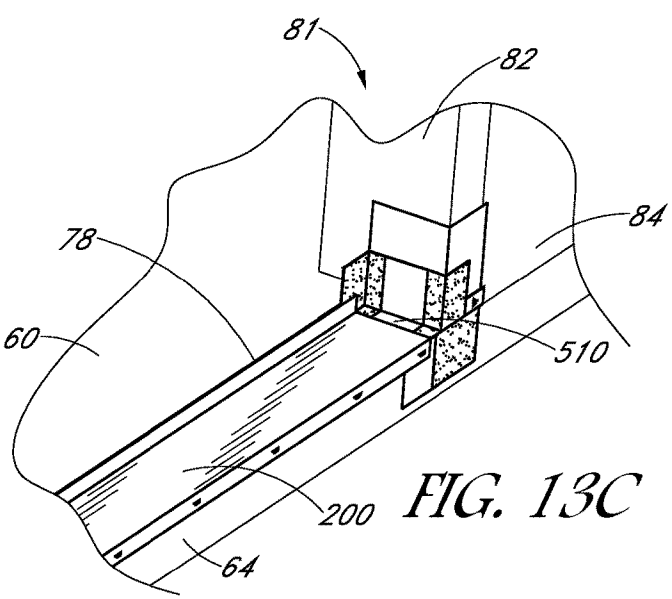

FIG. 13C shows an embodiment where a portion of the end dam 400 is wrapped around the corner member 500 and the right door stud 81 of the building wall. In certain embodiments, the portion 160 of the third vertical flange 130 contacts or overlaps at least a portion of the first vertical seating flange 310 of the corner member 500. In certain embodiments, the portion 160 of the third vertical flange 130 contacts or overlaps at least a portion of the second vertical surface 84 of the door stud 81. The portion 160 may be secured using one or more staples 90. Other means for securing may be used. For example, in some embodiments, the end dam 400 may be secured using nails, pins, screws, or adhesive. The material of the end dam 400 provides self-sealing around the staple 90 or other means for securing, thus maintaining the weather-tight seal for the door. In some embodiments, a securing means is not used. In some embodiments, the third vertical seating flange 130 does not extend further than the second vertical seating flange 320 of the corner member 500.

FIG. 13C also shows a right side portion of an insert 200 being placed on a horizontal surface 76 and on the end dam member 400. In certain embodiments, the right side portion of the insert 200 is placed on at least a portion of the horizontal seating flange 350 of the corner member 500. In certain embodiments, the second end 220 of the insert 200 is placed in the second end 74 of the channel 70 in the subfloor 60.

As shown in FIG. 13C, in some embodiments, the second end 220 of the insert 200 is positioned near the end dam 400 and the second door stud 81 so that there is a gap 510 between the second end 220 of the insert 200 and the first vertical seating flange 110 of the end dam 400. In some embodiments, there is no gap 510. In some embodiments, the second end 220 of the insert 200 abuts the first vertical seating flange 110 of the end dam 400. The base 230 of the insert 200 may partially overlap the base 140 of the end dam 400 or vice versa. In some embodiments, the base 230 of the insert 200 completely covers the base 140 of the end dam 400. In some embodiments, the base 230 of the insert 200 partially covers the base 140 of the end dam 400 so that a portion of the base 140 of the end dam 400 is exposed. In some embodiments, the base 230 of the insert 200 may partially overlap the horizontal seating flange 350 of the corner member 500. The base 230 of the insert 200 contacts or overlaps at least a portion of the horizontal surface 76 of the channel 70 in the subfloor 60.

In certain embodiments, sealant 80 is applied to the horizontal surface 76 and the end dam 400 before placement of the insert 200. In some embodiments, the sealant 80 is applied in a discontinuous method, for example, separate beads or lines. In some embodiments, a sealant is not applied. In some embodiments, the sealant 80 is applied to the insert 200 before installing the insert 200.

FIG. 13C also shows an embodiment where a portion of the insert 200 is wrapped around the edge of the subfloor 60. As shown in FIG. 13C, in some embodiments, the portion of the second vertical seating flange 250 that extends across the threshold is folded down and contacts or overlaps the first vertical surface 64 of the subfloor 60.

FIG. 13D shows an alternate embodiment to FIG. 13C where the portion of the insert 200 is removed instead of being wrapped around the edge of the subfloor 60. As shown in FIG. 13D, in some embodiments a portion of the second vertical seating flange 250 of the insert 200 is removed. In some embodiments, the insert 200 may not have a second vertical seating flange 250. In some embodiments, the second vertical seating flange 250 may extend partially along the length of the insert 200. While not shown in FIG. 13D, FIG. 13J shows both the right door stud 81 and the left door stud 20 of the recessed threshold with the insert 200 installed.

Figure 13F:
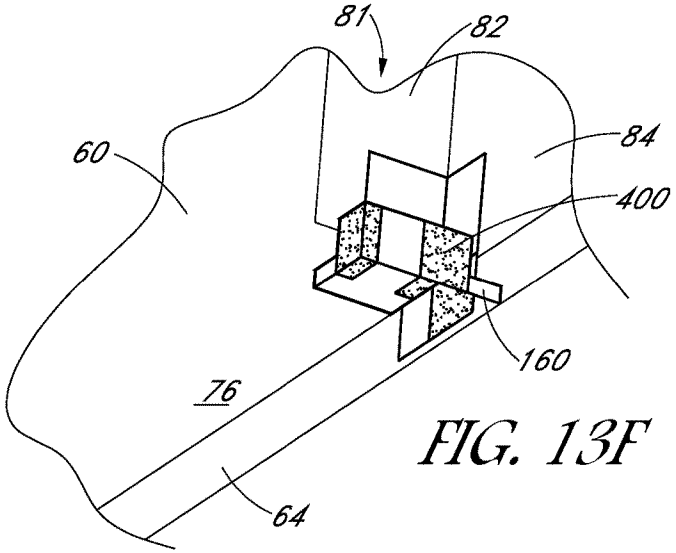
FIGS. 13E-H are close-up views of an exemplary right door stud of a flat threshold for a door system, such as stacking doors, French doors, or traditional sliding doors. While not shown in FIGS. 13E-H.
Figure 13H:
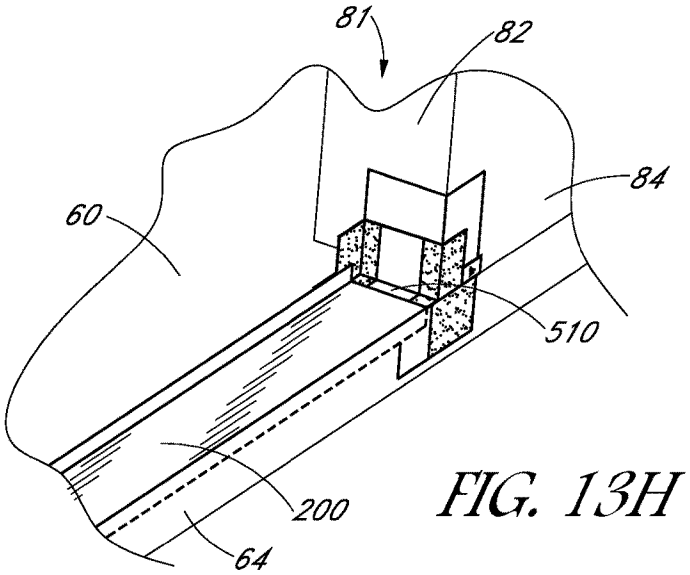
Figure 13E:
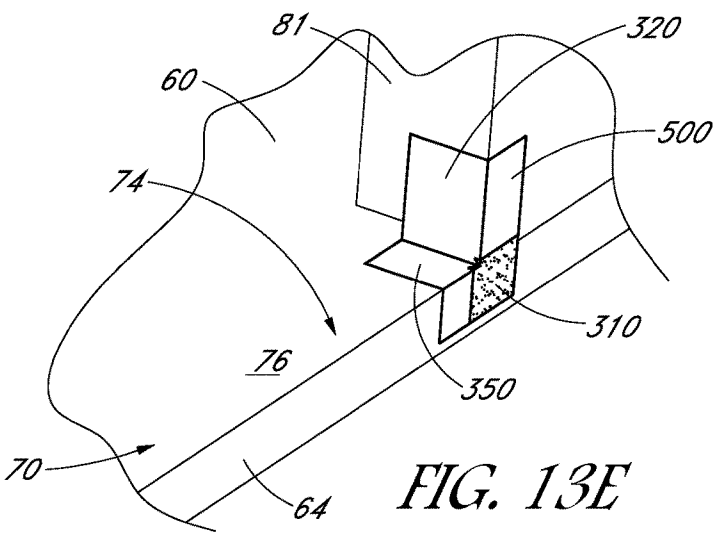

FIGS. 13E-H are close-up views of an exemplary right door stud 81 of a flat threshold for a door system, such as stacking doors, French doors, or traditional sliding doors. While not shown in FIGS. 13E-H, FIG. 13K shows both the right door stud 81 and the left door stud 20 of the recessed threshold with corners members 300, 500 installed. The left door stud 20 is a mirror image of the right door stud 81. Similarly, the installation of the door system in the regions of the right door stud 81 and the left door stud 20 is the same besides being a mirror image. FIG. 13E shows an embodiment of placing the corner member 500 near the right door stud 81. In certain embodiments, at least a portion of the corner member 500 is disposed against the second door stud 81. As is illustrated in FIG. 13E, the second door stud 81 is on a right side of the doorway. At least a portion of the corner member 500 is placed in the channel 70.

The corner member 500 may have a first vertical seating flange 310, a second vertical seating flange 320, and a horizontal seating flange 350. In the illustrated embodiment, the first vertical seating flange 310 of the corner member 500 is configured to be secured to an end of the door stud 81. For example, the first vertical sealing flange 310 can be secured against the second vertical surface 84. The second vertical seating flange 320 can be secured against the first vertical surface 82. In certain embodiments, the horizontal seating flange 350 is secured against the horizontal surface 76 of the channel 70.

In certain embodiments, the second vertical seating flange 320 and the horizontal seating flange 350 may be swapped depending on whether the corner member 500 is being placed on the first door stud 20 or the second door stud 81. In certain embodiments, the corner member 500 illustrated in FIG. 13E can be rotated 180 degrees about an axis defined by an intersection of the second vertical seating flange 320 with the horizontal seating flange 350 to place the corner member 500 against the door stud 20 illustrated in FIG. 13K. In certain embodiments, the corner member 300 illustrated in FIG. 13K can be a mirror image about any of the surfaces or flanges of the corner member 500 illustrated in FIG. 13E depending on the desired installed orientation.

In certain embodiments, each of the corner members 300, 500 is a separate piece from the sill pan assembly. In certain other embodiments, each of the corner members 300, 500 is integral to (e.g., monolithic construction) the sill pan assembly. For example, embodiments of the sill pan assembly installed with two corner members 300, 500 can include one monolithic piece. Of course, the embodiments disclosed herein are not limited to a specific number of pieces.

In certain embodiments, sealant 80 is applied before placing the corner member 500. In some embodiments, the sealant 80 is applied in a discontinuous method, for example, separate beads or lines. In some embodiments, a sealant 80 is not applied. In some embodiments, the sealant 80 may be applied to the corner member 500.

FIG. 13F shows an embodiment of placing an end dam 400 on the corner member 500 near the right door stud 81 prior to wrapping a portion 160 of the end dam 400 around the corner member 500 and the right door stud 81 of the building wall. The end dam 400 is disposed at the second end 74 of the channel 70. In certain embodiments, the base 140 of the end dam 400 contacts or overlaps at least a portion of the horizontal seating flange 350 of the corner member 500. In certain embodiments, the base 140 of the end dam 400 contacts or overlaps at least a portion of the horizontal surface 76 of the channel 70. In certain embodiments, the base 140 of the end dam 400 contacts or overlaps at least a portion of the horizontal seating flange 350 of the corner member 500 and at least a portion of the horizontal surface 76 of the channel 70.

In certain embodiments, the first vertical seating flange 110 of the end dam 400 contacts or overlaps at least a portion of the second vertical seating flange 320 of the corner member 500. In certain embodiments, the first vertical seating flange 110 of the end dam 400 contacts or overlaps at least a portion of the first vertical surface 82 of the second door stud 81. In certain embodiments, the first vertical seating flange 110 of the end dam 400 contacts or overlaps at least a portion of the second vertical seating flange 320 of the corner member 500 and at least a portion of the first vertical surface 82 of the second door stud 81.

In some embodiments, the edge 150 between the base 140 and the third vertical seating flange 130 is trimmed to allow the third vertical seating flange 130 to contact or overlap at least a portion of the first vertical seating flange 310 of the corner member 500, as shown in FIG. 13F. In some embodiments, the edge 150 between the base 140 and the third vertical seating flange 130 is trimmed to allow the third vertical seating flange 130 to contact or overlap at least a portion of the first vertical surface 82 of the second door stud 81. In some embodiments, the edge 150 between the base 140 and the third vertical seating flange 130 is trimmed to allow the third vertical seating flange 130 to contact or overlap at least a portion of the first vertical seating flange 310 of the corner member 500 and at least a portion of the first vertical surface 82 of the second door stud 81.

In some embodiments, the end dam 400 may come pre-cut. In some embodiments, the end dam 400 is formed such that the base 140 and the third vertical seating flange 130 are not connected so as to not need to be cut. In such embodiments, the end dam 400 may have a first vertical flange 110, a second vertical flange 120, and a base 140.

Figure 13G:
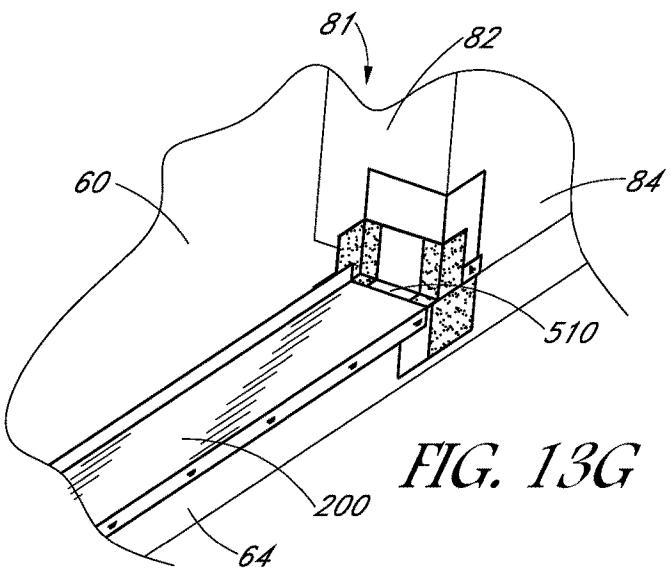
Figures 13I, 13J:
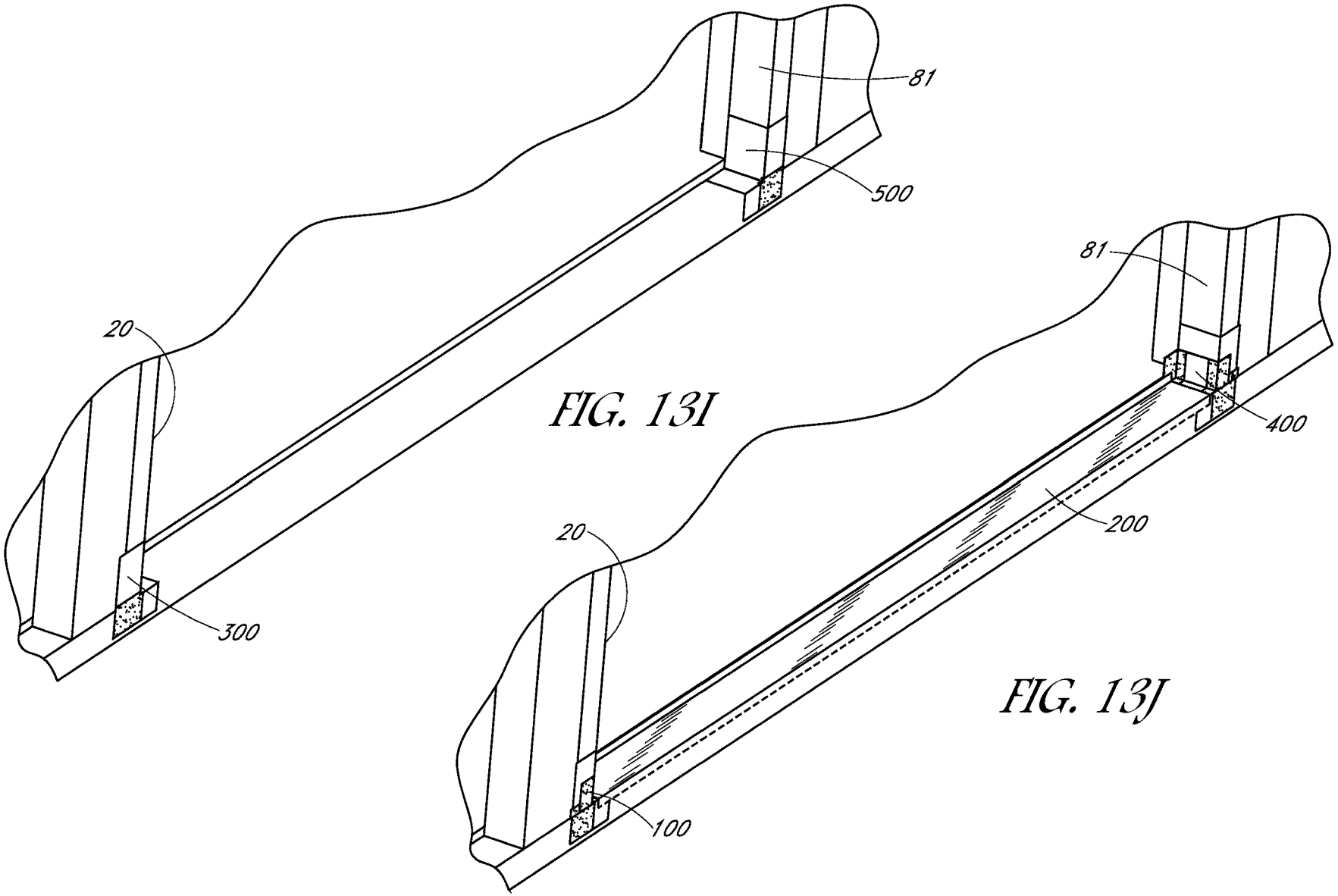
FIG. 13I shows both the right door stud and the left door stud of the recessed threshold with the first and second corners members installed. The left door stud is a mirror image of the right door stud. Similarly, the installation of the door system in the regions of the right door stud and the left door stud is the same besides being a mirror image.
FIG. 13J shows both the right door stud and the left door stud of the recessed threshold with the insert installed.

FIG. 13G shows an embodiment where a portion of the end dam 400 is wrapped around the corner member 500 and the right door stud 81 of the building wall. In certain embodiments, the portion 160 of the third vertical flange 130 contacts or overlaps at least a portion of the first vertical seating flange 310 of the corner member 500. In certain embodiments, the portion 160 of the third vertical flange 130 contacts or overlaps at least a portion of the second vertical surface 84 of the door stud 81. The portion 160 may be secured using one or more staples 90. Other means for securing may be used. For example, in some embodiments, the end dam 400 may be secured using nails, pins, screws, or adhesive. The material of the end dam 400 provides self-sealing around the staple 90 or other means for securing, thus maintaining the weather-tight seal for the door. In some embodiments, a securing means is not used. In some embodiments, the third vertical seating flange 130 does not extend further than the second vertical seating flange 320 of the corner member 500.

FIG. 13G also shows a right side portion of an insert 200 being placed on a horizontal surface 76 and on the end dam member 400. In certain embodiments, the right side portion of the insert 200 is placed on at least a portion of the horizontal seating flange 350 of the corner member 500. In certain embodiments, the second end 220 of the insert 200 is placed in the second end 74 of the channel 70 in the subfloor 60.

As shown in FIG. 13G, in some embodiments, the second end 220 of the insert 200 is positioned near the end dam 400 and the second door stud 81 so that there is a gap 510 between the second end 220 of the insert 200 and the first vertical seating flange 110 of the end dam 400. In some embodiments, there is no gap 510. In some embodiments, the second end 220 of the insert 200 abuts the first vertical seating flange 110 of the end dam 400. The base 230 of the insert 200 may partially overlap the base 140 of the end dam 400 or vice versa. In some embodiments, the base 230 of the insert 200 completely covers the base 140 of the end dam 400. In some embodiments, the base 230 of the insert 200 partially covers the base 140 of the end dam 400 so that a portion of the base 140 of the end dam 400 is exposed. In some embodiments, the base 230 of the insert 200 may partially overlap the horizontal seating flange 350 of the corner member 500. The base 230 of the insert 200 contacts or overlaps at least a portion of the horizontal surface 76 of the channel 70 in the subfloor 60.

In certain embodiments, sealant 80 is applied to the horizontal surface 76 and the end dam 400 before placement of the insert 200. In some embodiments, the sealant 80 is applied in a discontinuous method, for example, separate beads or lines. In some embodiments, a sealant is not applied. In some embodiments, the sealant 80 is applied to the insert 200 before installing the insert 200.

FIG. 13G also shows an embodiment where a portion of the insert 200 is wrapped around the edge of the subfloor 60. As shown in FIG. 13G, in some embodiments, the portion of the second vertical seating flange 250 that extends across the threshold is folded down and contacts or overlaps the first vertical surface 64 of the subfloor 60.

Figures 13K, 13L:
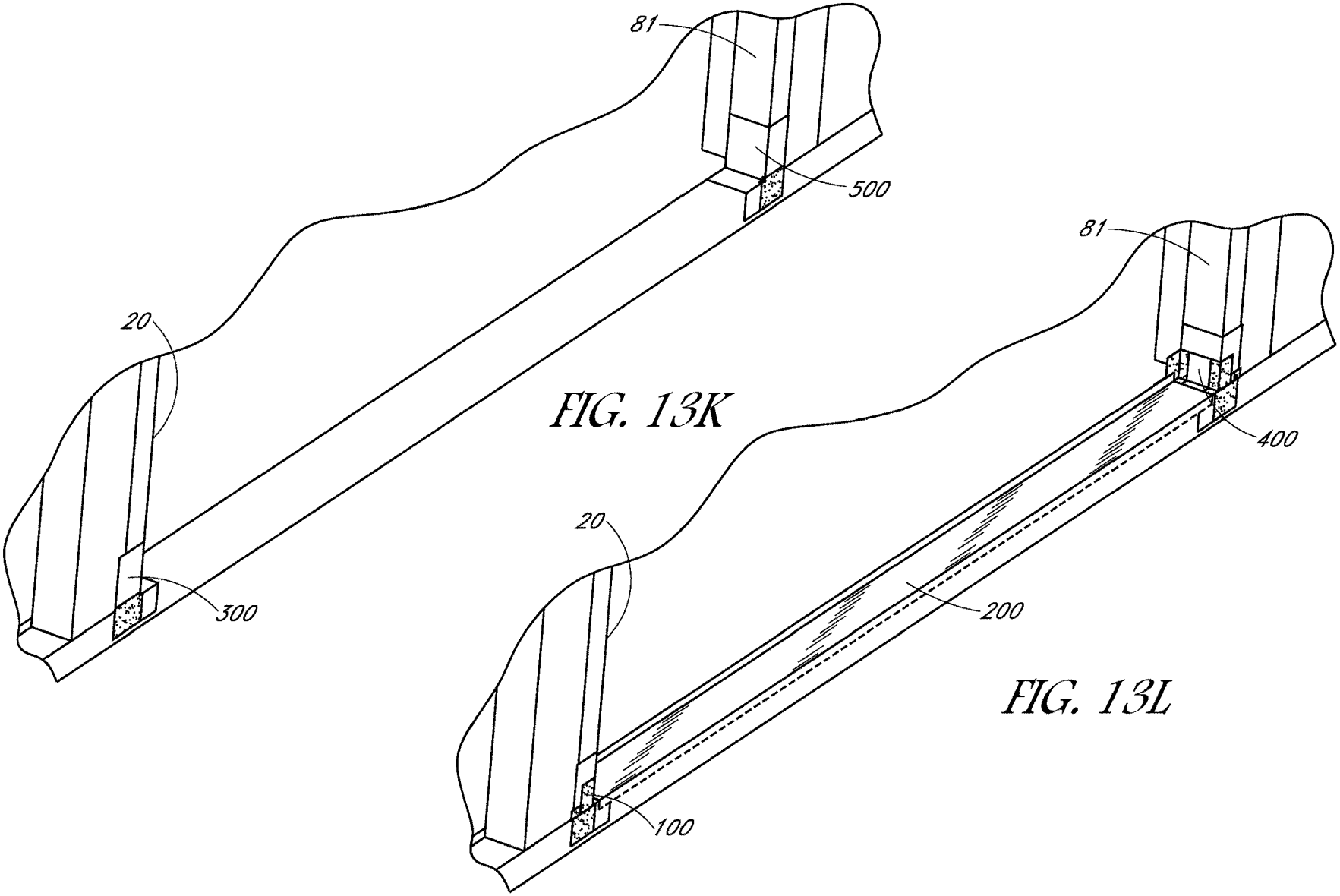
FIG. 13K shows both the right door stud and the left door stud of the flat threshold with the first and second corners members installed. The left door stud is a mirror image of the right door stud. Similarly, the installation of the door system in the regions of the right door stud and the left door stud is the same besides being a mirror image.
FIG. 13L shows both the right door stud and the left door stud of the flat threshold with the insert installed.

FIG. 13H shows an alternate embodiment to FIG. 13G where the portion of the insert 200 is removed instead of being wrapped around the edge of the subfloor 60. As shown in FIG. 13H, in some embodiments a portion of the second vertical seating flange 250 of the insert 200 is removed. In some embodiments, the insert 200 may not have a second vertical seating flange 250. In some embodiments, the second vertical seating flange 250 may extend partially along the length of the insert 200. While not shown in FIG. 13H, FIG. 13L shows both the right door stud 81 and the left door stud 20 of the flat threshold with the insert 200 installed.

Figure 14:
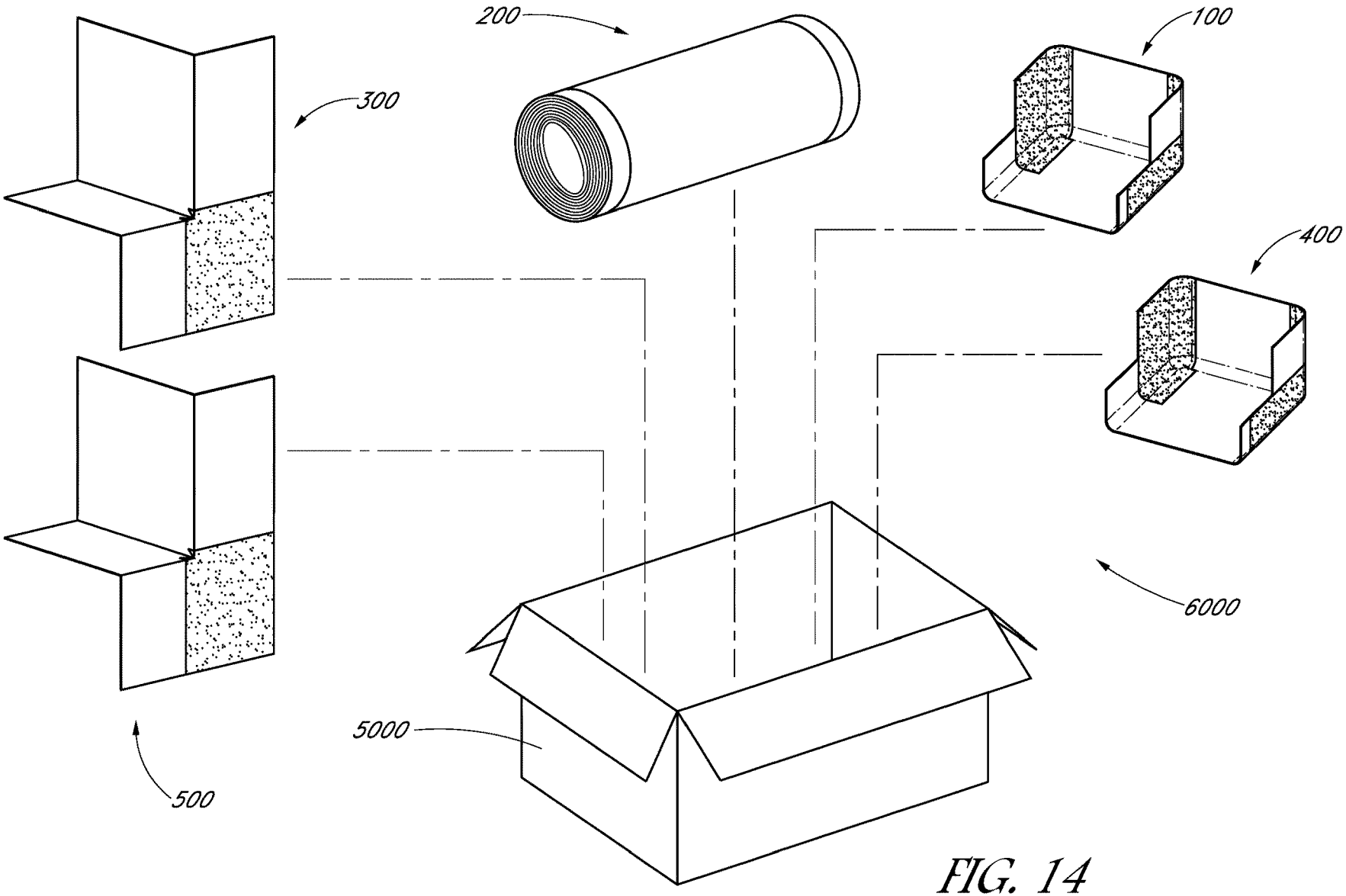
FIG. 14 is a perspective view of an embodiment of a kit for a multi-piece, flexible, sill pan that includes two end dams, two corner members, and an insert. In certain embodiments, each of the two corner members is a separate piece from the sill pan assembly. In certain other embodiments, one or both of the two corner members is integral to (e.g., monolithic construction) the sill pan assembly. For example, embodiments of the sill pan assembly installed with two corner member can include one monolithic piece. In certain embodiments, each of the two end dams is a separate piece from the sill pan assembly. In certain other embodiments, one or both of the end dams is integral to (e.g., monolithic construction) the sill pan assembly. For example, embodiments of the sill pan assembly installed with two end dams can include one monolithic piece.

FIG. 14 shows an embodiment of a kit 6000 for a sill pan door assembly. As shown in FIG. 14, in some embodiments, the kit 6000 includes two end dams 100, 400, an insert 200, and two corner members 300, 500.

In certain embodiments, each of the two corner members 300, 500 is a separate piece from the sill pan assembly. In certain other embodiments, one or both of the two corner members 300, 500 is integral to (e.g., monolithic construction) the sill pan assembly. For example, embodiments of the sill pan assembly installed with two corner member 300, 500 can include one monolithic piece. In certain embodiments, each of the two end dams 100, 400 is a separate piece from the sill pan assembly. In certain other embodiments, one or both of the end dams 100, 400 is integral to (e.g., monolithic construction) the sill pan assembly. For example, embodiments of the sill pan assembly installed with two end dams 100, 400 can include one monolithic piece.

This type of kit may be used for flashing and sealing around exterior door systems such as pocket doors. In certain embodiments, the door system is a single-pocket door that retracts the door on the left side. In certain embodiments, the door system is a single-pocket door that retracts the door on the right side. In certain other embodiments, the exterior doors are stacking doors, French doors, or traditional sliding doors.

The pieces 100, 200, 300, 400, 500 may be placed in a container 5000. As shown in FIG. 14, the container 5000 may be a box. In some embodiments, the container 5000 may be a bag, wrap, or other suitable container for containing the flexible pieces 100, 200, 300, 400, 500.

The insert 200 may be rolled or folded since the insert 200 is constructed from a flexible material, making it more convenient and/or saving spacing when packing the insert 200 in the container 5000. The corner members 300, 500 may be folded since they are constructed from a flexible material, making it more convenient and/or saving spacing when packing the corner members 300, 500 in the container 5000.

In some embodiments, the kit 6000 may include an end dam that is shaped similar to end dam 400 as shown in FIG. 12B, where the end dam 400 is formed such that the base 140 and the third vertical seating flange 130 are not connected.

It will be appreciated by those skilled in the art that various modifications and changes may be made without departing from the scope of the described technology. Such modifications and changes are intended to fall within the scope of the embodiments. It will also be appreciated by those of skill in the art that parts included in one embodiment are interchangeable with other embodiments; one or more parts from a depicted embodiment can be included with other depicted embodiments in any combination. For example, any of the various components described herein and/or depicted in the Figures may be combined, interchanged or excluded from other embodiments.

With respect to the use of substantially any plural and/or singular terms herein, those having skill in the art can translate from the plural to the singular and/or from the singular to the plural as is appropriate to the context and/or application. The various singular/plural permutations may be expressly set forth herein for sake of clarity.

It will be understood by those within the art that, in general, terms used herein are generally intended as "open" terms (e.g., the term "including" should be interpreted as "including but not limited to," the term "having" should be interpreted as "having at least," the term "includes" should be interpreted as "includes but is not limited to," etc.). It will be further understood by those within the art that if a specific number of an introduced claim recitation is intended, such an intent will be explicitly recited in the claim, and in the absence of such recitation no such intent is present. For example, as an aid to understanding, the following appended claims may contain usage of the introductory phrases "at least one" and "one or more" to introduce claim recitations. However, the use of such phrases should not be construed to imply that the introduction of a claim recitation by the indefinite articles "a" or "an" limits any particular claim containing such introduced claim recitation to embodiments containing only one such recitation, even when the same claim includes the introductory phrases "one or more" or "at least one" and indefinite articles such as "a" or "an" (e.g., "a" and/or "an" should typically be interpreted to mean "at least one" or "one or more"); the same holds true for the use of definite articles used to introduce claim recitations. In addition, even if a specific number of an introduced claim recitation is explicitly recited, those skilled in the art will recognize that such recitation should typically be interpreted to mean at least the recited number (e.g., the bare recitation of "two recitations," without other modifiers, typically means at least two recitations, or two or more recitations). Furthermore, in those instances where a convention analogous to "at least one of A, B, and C, etc." is used, in general such a construction is intended in the sense one having skill in the art would understand the convention (e.g., "a system having at least one of A, B, and C" would include but not be limited to systems that have A alone, B alone, C alone, A and B together, A and C together, B and C together, and/or A, B, and C together, etc.). In those instances where a convention analogous to "at least one of A, B, or C, etc." is used, in general such a construction is intended in the sense one having skill in the art would understand the convention (e.g., "a system having at least one of A, B, or C" would include but not be limited to systems that have A alone, B alone, C alone, A and B together, A and C together, B and C together, and/or A, B, and C together, etc.). It will be further understood by those within the art that virtually any disjunctive word and/or phrase presenting two or more alternative terms, whether in the description, claims, or drawings, should be understood to contemplate the possibilities of including one of the terms, either of the terms, or both terms. For example, the phrase "A or B" will be understood to include the possibilities of "A" or "B" or "A and B."

The above description discloses several methods and materials of the present invention. This invention is susceptible to modifications in the methods and materials, as well as alterations in the fabrication methods and equipment and in the installation methods and equipment. Such modifications will become apparent to those skilled in the art from a consideration of this disclosure or practice of the invention disclosed herein. Consequently, it is not intended that this invention be limited to the specific embodiments disclosed herein, but that it cover all modifications and alternatives coming within the true scope and spirit of the invention as embodied in the attached claims.

What is claimed is:

1. A method of installing a multi-piece, flexible, sill pan in a framed wall condition in a building wall that is configured to receive a pocket door for a doorway, the framed wall condition including an inner frame, an outer frame, and a first door stud together defining an internal space for receiving the pocket door, a bottom of the internal space being formed by a channel in a subfloor, the channel in the subfloor extending from the first door stud to a second door stud disposed on an opposite side of the doorway, the method comprising:

securing a first flexible end dam member between the inner and outer frames, and against the first door stud such that a first vertical seating flange of the first flexible end dam member contacts a generally vertical surface of the first door stud, a second vertical seating flange of the first flexible end dam member contacts a generally vertical surface of the inner frame, a third vertical seating flange of the first flexible end dam member contacts a generally vertical surface of the outer frame, and a generally horizontal base of the first flexible end dam member contacts a generally horizontal surface of the subfloor in the channel;

securing a first flexible corner member against the second door stud such that a first vertical seating flange of the first flexible corner member contacts a first generally vertical surface of the second door stud, a second vertical seating flange of the first flexible corner member contacts a second generally vertical surface of the second door stud outside the channel, a generally horizontal seating flange of the first flexible corner member contacts a generally horizontal surface of the subfloor in the channel;

securing a second flexible corner member to the outer frame and the subfloor such that a first vertical seating flange of the second flexible corner member contacts a generally vertical surface of an end of the outer frame, a second vertical seating flange of the second flexible corner member contacts a generally vertical surface of the outer frame, a third generally vertical seating flange of the second flexible corner member contacts a generally vertical surface of the subfloor outside the channel, and a generally horizontal seating flange of the second flexible corner member contacts a generally horizontal surface of the subfloor in the channel;

securing a second flexible end dam member against the first flexible corner member such that a first vertical seating flange of the second flexible end dam member contacts the first vertical seating flange of the first flexible corner member, a second vertical seating flange of the second flexible end dam member contacts the second vertical seating flange of the first flexible corner member, and a generally horizontal base of the second flexible end dam member contacts the generally horizontal seating flange of the first flexible corner member; and securing a flexible insert in the channel in the subfloor and between the first and second flexible end dam members such that a base of the flexible insert contacts a generally horizontal surface of the subfloor in the channel and overlaps the horizontal seating flange of the second flexible corner member, a first end of the flexible insert overlaps at least a portion of the horizontal seating flange of the first flexible end dam member, and a second end of the flexible insert overlaps at least a portion of the horizontal seating flange of the second flexible end dam member.

2. The method of claim 1, further comprising trimming at least a portion of the flexible insert to a bottom surface of the channel in the subfloor.

3. The method of claim 1, further comprising trimming at least a portion of the second flexible end dam member to a bottom surface of the channel in the subfloor.

4. The method of claim 1, wherein a thicknesses of a material used to construct the first flexible end dam member, the second flexible end dam member, the first corner member, the second corner member, and the flexible insert is between 20 mil and 30 mil.

5. The method of claim 1, wherein a material used to construct the first flexible end dam member, the second flexible end dam member, the first corner member, the second corner member, and the flexible insert is an asphalt- or petroleum-based flashing material.

6. The method of claim 1, wherein a material used to construct the first flexible end dam member, the second flexible end dam member, the first corner member, the second corner member, and the flexible insert is a butyl-based flashing material.

7. The method of claim 1, wherein the first flexible end dam member is integral with the flexible insert.

8. The method of claim 1, further comprising securing the first flexible end dam member.

9. The method of claim 8, further comprising securing the second flexible end dam member.

10. The method of claim 9, further comprising securing the first flexible corner member and the second flexible corner member.

11. The method of claim 1, further comprising cutting a portion of the second flexible corner member to form the second vertical seating flange.

12. The method of claim 1, wherein the flexible insert overlaps at least portions of each of the first flexible end dam, the second flexible end dam, the first corner member, and the second corner member.

13. A method of installing a multi-piece sill pan in a framed wall condition in a building wall that is configured to receive a door for a doorway, the framed wall condition including a first door stud and a second door stud defining a doorway therebetween for receiving the door, the method comprising:

securing a first corner member against the first door stud such that a first vertical seating flange of the first corner member overlaps a first vertical surface of the first door stud, a second vertical seating flange of the first corner member overlaps a second vertical surface of the first door stud outside the doorway, a horizontal seating flange of the first corner member overlaps a horizontal surface in the doorway;

securing a second corner member against the second door stud such that a first vertical seating flange of the second corner member overlaps a first vertical surface of the second door stud, a second vertical seating flange of the second corner member overlaps a second vertical surface of the second door stud outside the doorway, a horizontal seating flange of the second corner member overlaps the horizontal surface in the doorway;

securing a first end dam member over the first corner member such that a first vertical seating flange of the first end dam member overlaps the first vertical seating flange of the first corner member, a second vertical seating flange of the first end dam member overlaps the second vertical seating flange of the first corner member, and a generally horizontal base of the first end dam member overlaps the horizontal seating flange of the first corner member;

securing a second end dam member over the second corner member such that a first vertical seating flange of the second end dam member overlaps the first vertical seating flange of the second corner member, a second vertical seating flange of the second end dam member overlaps the second vertical seating flange of the second corner member, and a generally horizontal base of the second end dam member overlaps the horizontal seating flange of the second corner member; and securing an insert in the doorway and between the first and second end dam members such that a base of the insert overlaps a horizontal surface in the doorway, a first end of the insert overlaps at least a portion of the horizontal seating flange of the first end dam member and at least a portion of the horizontal seating flange of the first corner member, and a second end of the insert overlaps at least a portion of the horizontal seating flange of the second end dam member and at least a portion of the horizontal seating flange of the second corner member.

14. The method of claim 13, further comprising trimming at least a portion of the insert to a level of the doorway.

15. The method of claim 13, wherein a thicknesses of a material used to construct the first end dam member, the second end dam member, the first corner member, the second corner member, and the insert is between 20 mil and 30 mil.

16. The method of claim 13, wherein a material used to construct the first end dam member, the second end dam member, the first corner member, the second corner member, and the insert is an asphalt- or petroleum-based flashing material.

17. The method of claim 13, wherein at least two of the first end dam member, the second end dam member, the first corner member, the second corner member, and the insert are manufactured as one monolithic piece.

18. A kit for a multi-piece sill pan to be installed in a framed wall condition in a building wall that is configured to receive a door for a doorway, the framed wall condition including a first door stud and a second door stud defining a doorway therebetween for receiving the door, the kit comprising:

a first corner member configured to be secured against the first door stud such that a first vertical seating flange of the first corner member overlaps a first vertical surface of the first door stud, a second vertical seating flange of the first corner member overlaps a second vertical surface of the first door stud outside the doorway, a horizontal seating flange of the first corner member overlaps a horizontal surface in the doorway;

a second corner member configured to be secured against the second door stud such that a first vertical seating flange of the second corner member overlaps a first vertical surface of the second door stud, a second vertical seating flange of the second corner member overlaps a second vertical surface of the second door stud outside the doorway, a horizontal seating flange of the second corner member overlaps the horizontal surface in the doorway;

a first end dam member configured to be secured over the first corner member such that a first vertical seating flange of the first end dam member overlaps the first vertical seating flange of the first corner member, a second vertical seating flange of the first end dam member overlaps the second vertical seating flange of the first corner member, and a generally horizontal base of the first end dam member overlaps the horizontal seating flange of the first corner member;

a second end dam member configured to be secured over the second corner member such that a first vertical seating flange of the second end dam member overlaps the first vertical seating flange of the second corner member, a second vertical seating flange of the second end dam member overlaps the second vertical seating flange of the second corner member, and a generally horizontal base of the second end dam member overlaps the horizontal seating flange of the second corner member; and an insert configured to be secured in the doorway and between the first and second end dam members such that a base of the insert overlaps a horizontal surface in the doorway, a first end of the insert overlaps at least a portion of the horizontal seating flange of the first end dam member and at least a portion of the horizontal seating flange of the first corner member, and a second end of the insert overlaps at least a portion of the horizontal seating flange of the second end dam member and at least a portion of the horizontal seating flange of the second corner member.

19. The kit of claim 18, wherein a thicknesses of a material used to construct the first end dam member, the second end dam member, the first corner member, the second corner member, and the insert is between 20 mil and 30 mil.

20. The kit of claim 18, wherein a material used to construct the first end dam member, the second end dam member, the first corner member, the second corner member, and the insert is an asphalt- or petroleum-based flashing material.

* * * * *